US005381629A

United States Patent [19]

Salvail

[11] Patent Number: 5,381,629

[45] Date of Patent: Jan. 17, 1995

[54] PORTABLE SHARPENER

[76] Inventor: Roger Salvail, 187 Des Ormes, Drummondville, QC, Canada, J2C 1T2

[21] Appl. No.: 950,851

[22] Filed: Sep. 25, 1992

[51] Int. Cl.[6] ..... B21F 17/00

[52] U.S. Cl. ..... 451/540; 451/557; 451/545

[58] Field of Search ..... 51/204, 205 R, 205 WG, 51/285

[56] References Cited

U.S. PATENT DOCUMENTS

| | | | |
|---|---|---|---|
| 2,042,916 | 6/1936 | Viozzi | 51/205 |
| 2,054,495 | 9/1936 | Corkum | 51/205 |
| 2,092,831 | 9/1937 | Cannon | 51/205 |
| 2,118,617 | 5/1938 | Nicolet | 51/205 |
| 2,428,473 | 10/1947 | Slocum | 51/205 |
| 2,542,281 | 2/1951 | Lefteruk | 51/204 |
| 2,999,402 | 9/1961 | Bratton | 76/83 |
| 3,157,973 | 11/1964 | Chattillion | 51/392 |
| 3,585,880 | 6/1971 | Kabriel | 76/83 |
| 3,841,030 | 10/1974 | Laszlo | 51/170 PT |
| 3,921,341 | 11/1975 | Thompson | 51/205 WG |
| 4,617,765 | 10/1986 | Weiler | 51/205 WG |
| 4,756,125 | 7/1988 | Kadnar | 51/102 |
| 4,815,240 | 3/1989 | Larson | 51/205 WG |
| 4,908,994 | 3/1990 | Fraser | 51/208 |
| 5,189,845 | 3/1993 | Courchesne | 51/205 R |
| 5,195,277 | 3/1993 | Courchesne | 51/205 R |

FOREIGN PATENT DOCUMENTS 2043165 12/1991 Canada .

*Primary Examiner*—M. Rachuba
*Attorney, Agent, or Firm*—Foley & Lardner

[57] ABSTRACT

A portable sharpener for blades having a main portion with at least one cutting edge and at least one end portion having at least one straight or slightly curved cutting edge, the sharpener comprising a housing for a selectively positionable abrasive file having at least one abrasive surface; a first guide to guide the blade against the abrasive surface; a housing for recovering the blade filing; and a removable crutch mounted on the body and provided with a second abrasive file and with a second guide for the blade, the crutch allowing the end portions of the blade to be sharpened.

22 Claims, 23 Drawing Sheets

PORTABLE SHARPENER

FIELD OF THE INVENTION

The present invention relates to a portable sharpener for a blade of the type comprising at least one cutting edge (preferably two parallel cutting edges) immovably attached to a main portion of at least one end portion (preferably two end portions), the end portion(s) extending said maid portion and being substantially curved. Preferably, the blade is the one of an iceskates, especially of a hockey skate.

DESCRIPTION OF THE PRIOR ART

Canadian patent application No. 2,043,165 describes a blade sharpener, in particular of blades of hockey skates, comprising, in combination:

a prehension member, a follower member, said prehension member having pivot means which are adjustable and oriented according to an angle with the portion of the body, and a body portion having means for receiving therein an abrasive member or a neutral member, said body portion having orientation ends positioned for engaging the blade, said follower member having a body portion and means for engaging the blade, the body portion of the follower member having means for receiving therein an abrasive member or a neutral member, said follower member having pivoting means at one of its ends, and means for pivot engagement for subjecting pivoting engagement means of the prehension member with pivoting engagement means of the follower member.

Portable sharpeners of the prior art, in particular those of the type described in the published Canadian patent application No. 2,043,165, have the disadvantage to have few stability as a result of the large span between the leaning points, on one hand, and on the other hand, as a results that those leaning points are located on the ends of the blade to be sharpened. Furthermore, the sharpener described in the published Canadian patent application No. 2,043,165, on one hand requires the use of a cumbersome follower member, and, on the other hand, allow to sharpen the cutting edge(s) of the blade in a same direction according to the prescribed art for an adequate sharpening (the bite of a file in one direction is different from the one in an opposite direction), at the expense of laborious steps by which it must mount and dismount the abrasive member and the neutral member for interchanging them.

There is thus exists a need for a portable sharpener allowing with a reduce number of very simple and not laborious steps to proceed with the sharpening of a blade of the type comprising a main portion provided with one or several cutting edges and one or two end portions each provided with one or several cutting edges.

SUMMARY OF THE INVENTION

The present invention has for object a portable sharpener for blade of the type comprising a main portion provided with one or several cutting edges and one or two end portions each provided with one or several cutting edges.

The invention has also for object a portable sharpener for blade of the type defined previously, that is very simple to use, cheap to manufacture, long lasting and that allows the sharpening of all the parts of the cutting edge(s) of said blade.

The invention has also for object a portable sharpener that allows to sharpen the cutting edge(s) of a blade in a same direction for thus respecting a rule book in the field of sharpening, without being obliged to resort to laborious steps for modifying the orientation of the file.

The invention has furthermore for object a sharpener where the orientation of the file with respect to cutting edge(s) of the blade is let to a mere positioning generated by the contacting of the file with the cutting edge(s) of the blade, as far as the file is maintained in an alignment parallel to said cutting edge(s).

More particularly, the invention relates to a portable sharpener for blade of the type comprising a main portion provided with one or several cutting edges and one or two end portions each provided with one or several cutting edge(s), said main portion having parallel lateral faces and one or several cutting edge(s) substantially straight or slightly curved and when more than one cutting edge is provided, said cutting edges being substantially parallel between them, each of end portions extending one corresponding end of the main portion and each having lateral faces parallel and coplanar with those of the main portion and having one or several cutting edges substantially curved, said sharpener comprising a body having a main longitudinal axis, a housing and including:

a file having a longitudinal axis and at least one abrasive surface parallel to said longitudinal axis and to the longitudinal axis of the body;

means for fastening the file in the housing;

first guiding means for allowing to a portion of the cutting edge(s) of the blade to be moved against the abrasive surface of the file along the longitudinal axis of this one;

means for recovering the filings obtained during the sharpening of the blade, said means being located between said first guiding means and the abrasive surface of the file; and means for the selective positioning of said abrasive surface with respect to said cutting edge(s) of the main portion of the blade, between at least two distinct positions, a first of those distinct position being defined when the cutting edge(s) of the main portion of the blade may be substantially parallel or tangent with the abrasive surface, another of said distinct positions being defined when the cutting edge(s) of the main portion of the blade may form an angle, in particular an acute angle, with respect to the abrasive surface and that the cutting edge(s) of one of the end portions may be substantially tangent with at least one portion of the abrasive surface, said means comprising:

a removable crutch mounted on the body and provided with second guiding means intended to contact a portion of the cutting edge(s), said crutch being mounted on a removable way on the body between two distinct positions, that is at least one distinct position where the second guiding means are not intended to be in contact with the cutting edge(s) to allow to said abrasive surface to be contacted by the cutting edge(s) in a way substantially parallel or tangent, and at least one other distinct position where the second guiding means are intended to be in contact with the cutting edge(s) and positioned between the file and the cutting edge(s) of the main portion of the blade to thus allow to lift one end of the file with respect to the cutting edge(s) of the main portion of the blade and thus define an angle, in particular an acute angle, between them;

means for moving the crutch between one distinct position toward another distinct position;

being understood that when the crutch is positioned in such a way to have its second guiding means between the file and the cutting edge(s) of the main portion of the blade, said second means cooperate with the first guiding means for guiding at least a portion of the cutting edge(s) of a corresponding end portion of the blade along the abrasive surface of the file and thus allow to sharpen said cutting edge(s).

The invention has preferably for object a portable sharpener as defined previously, for sharpening a blade of the type comprising a main portion provided with two parallel cutting edges and end portions each provided with two parallel cutting edges, said main portion of the blade having cutting edges that are slightly curved, in particular a hockey skate, characterized in that the crutch may be mounted in a removable way on the body at either ends thereof to allow the file to sharpen the cutting edges of the blade, preferably in a same direction.

The invention further relates to a portable sharpener for blade of the type defined previously, said sharpener comprising a body having a main longitudinal axis and including:

a file having a longitudinal axis and at least one abrasive surface parallel to said longitudinal axis and to the longitudinal axis of the body;

guiding means for allowing a portion of the cutting edges of the blade to be moved against the abrasive surface of the file along the longitudinal axis of this one;

means for recovering the filings obtained during the sharpening of the blade, said means being located between said guiding means and the abrasive surface of the file; and means for moving guiding means parallel to lateral faces of the blade and keeping these latter between said guiding means.

BRIEF DESCRIPTION OF THE DRAWINGS

The present invention will be better understood at the reading of the following description of preferred aspects of this, one made with reference to the following drawings:

FIGS. 11 to 16 represent various ways for positioning the file inside the body of the sharpener via the variant of fixation of FIGS. 11 and 12;

FIGS. 28 to 30 represent how we can use a sharpener according to a first aspect of the invention;

FIGS. 28*a* to 30*a*, 28*b* to 30*b*, 28*c* to 30*c* and 28*d* to 30*d* represent how we can use a sharpener according to variants of the invention;

DESCRIPTION OF PREFERRED EMBODIMENTS OF THE INVENTION

Figure 1:
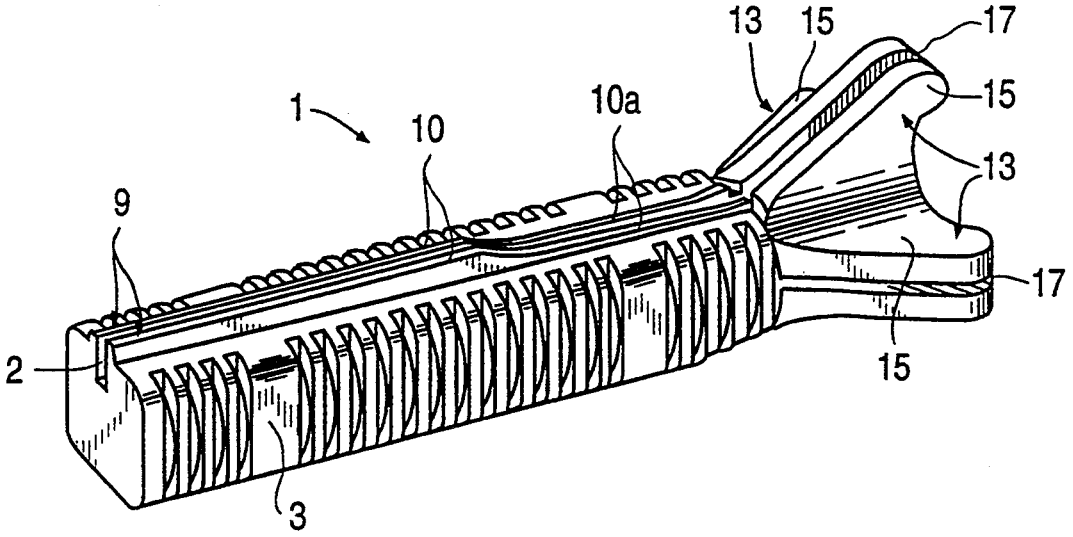
FIG. 1 represents a perspective view of the underneath of a sharpener according to the invention.
Figure 2:
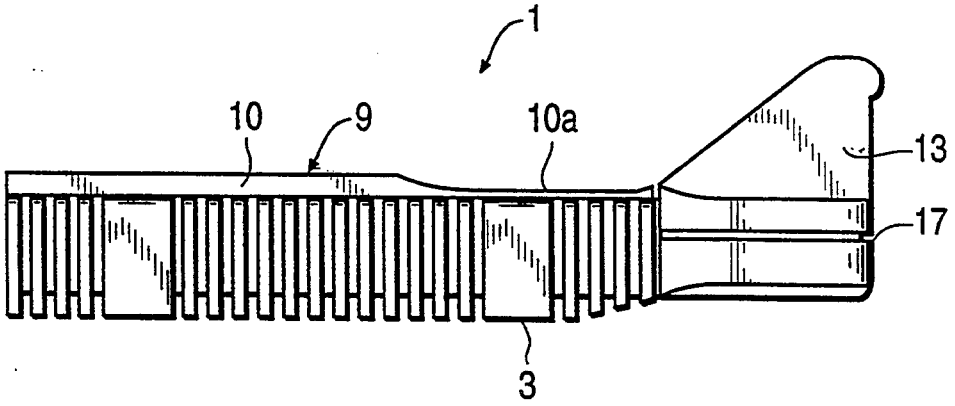
FIG. 2 a side elevational view of the sharpener of FIG. 1.
Figure 1A:
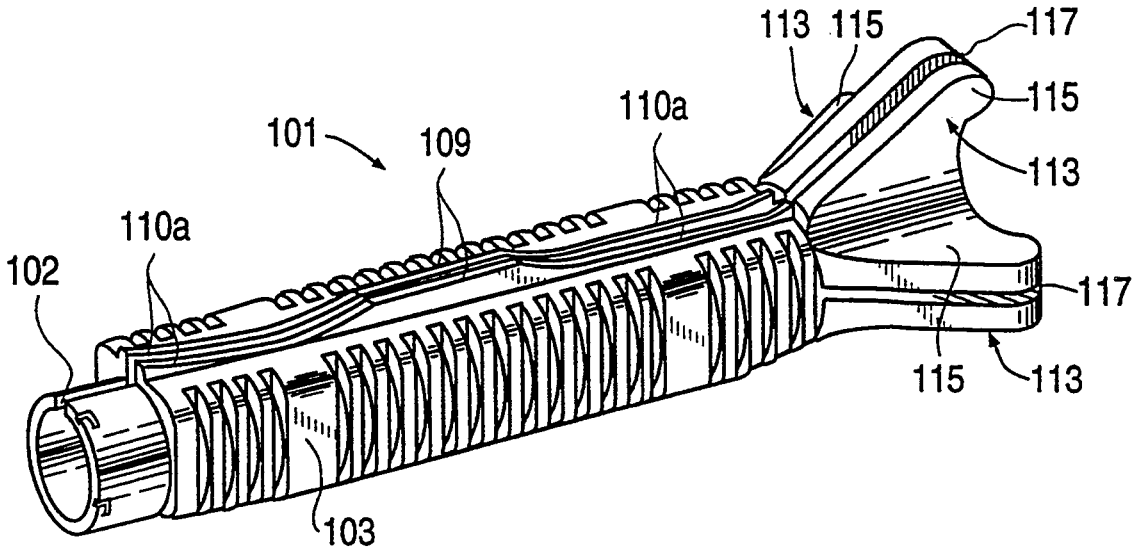
FIG. 1*a* represents a perspective view of the underneath of the first variant of the sharpener of FIG. 1.
Figure 2A:
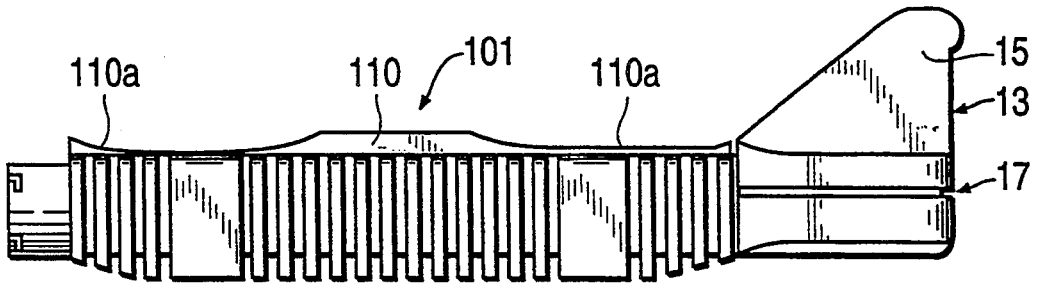
FIG. 2*a* represents side elevational view of the sharpener of FIG. 1*a;*
Figure 3:
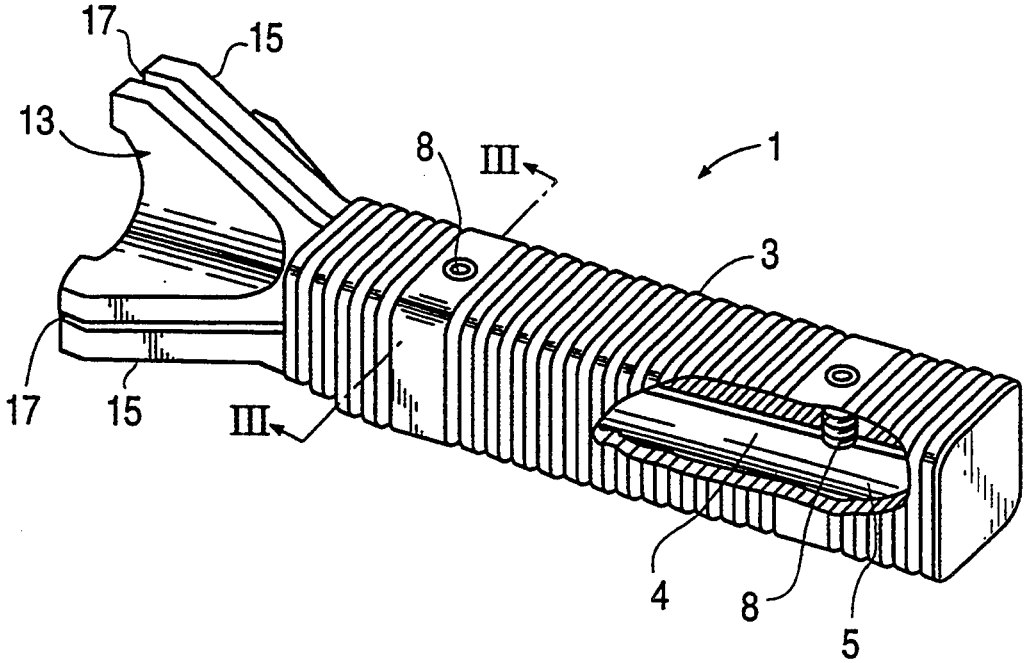
FIG. 3 represents a perspective view the top of the sharpener of FIG. 1 with a partial representation of the inside of this one.
Figure 4:
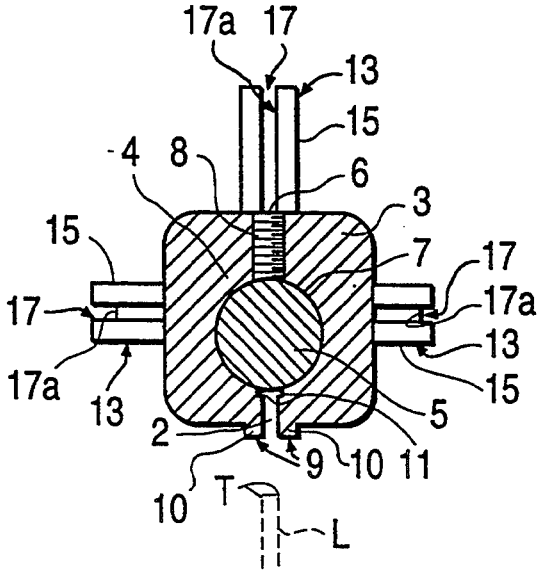
FIG. 4 represents a cross-sectional view according to III—III of the sharpener of FIG. 3.
Figure 3A:
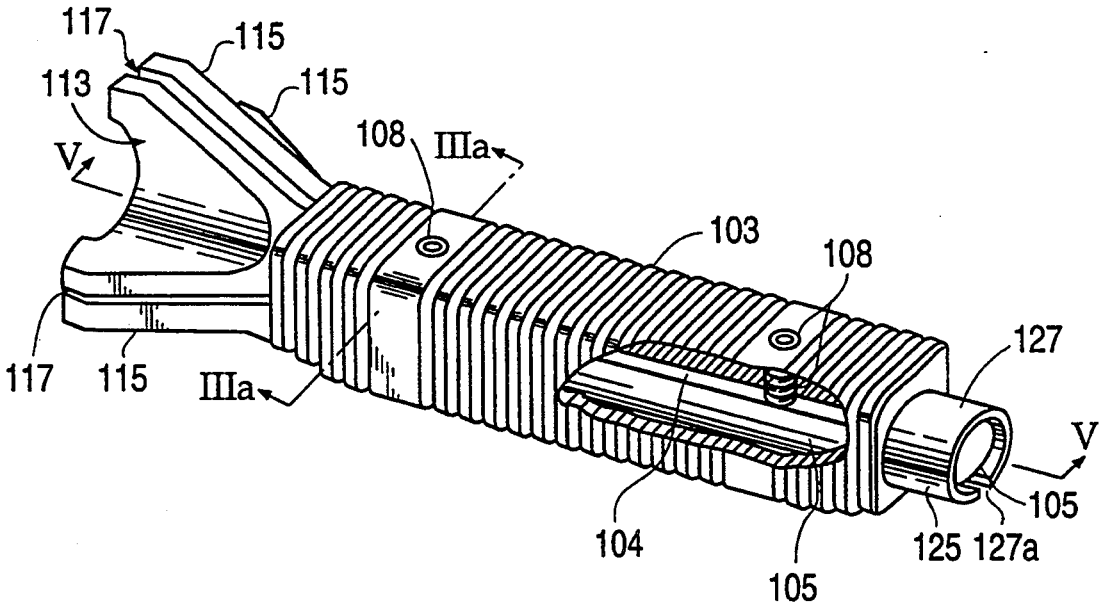
FIG. 3*a* represents a perspective view of the top of the sharpener of FIG. 1*a* with a partial representation of the inside of this one.
Figure 4A:
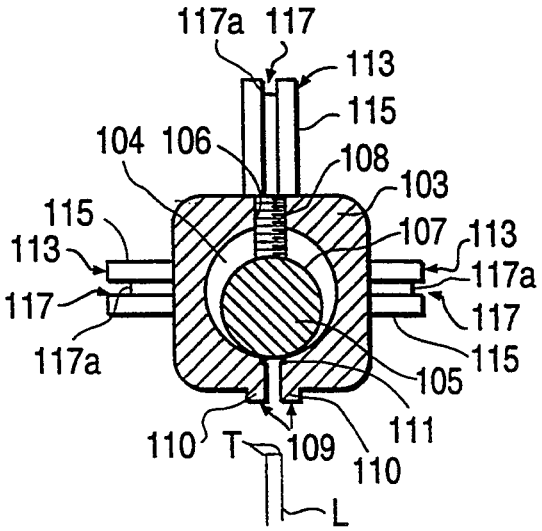
FIG. 4*a* represents a cross-sectional and exploded view according to IIIa—IIIa of the sharpener of FIG. 3*a;*

Referring to FIGS. 1 to 6 and 28 to 30, the invention relates to a portable sharpener 1 for sharpening a blade of the type comprising a main portion provided with one or several cutting edges and one or two end portions each provided with one or several cutting edges, said main portion having parallel lateral faces and one or several cutting edges substantially straight or slightly curved. and when more that one cutting edge is provided, said cutting edges being substantially parallel between them, each of end portions extending one corresponding end of the main portion and each having lateral faces parallel and coplanar with those of the main portion and having one or several cutting edges substantially curved. Advantageously, referring to FIGS. 4 and 28 to 30, the blade "L" is of the type comprising a main portion provided with two cutting edges parallel and slightly curved "TP" and two end portions each provided with two cutting edges "TE", and, preferably, the blade is the one of a hockey skate "H".

This sharpener 1 comprises a body 3 having a main longitudinal axis, a housing 4 and including:

a file 5 having a longitudinal axis and at least one abrasive surface 7 parallel to said longitudinal axis and to the longitudinal axis of the body;

means for fastening the file 5 in the housing 4;

first guiding means 9 for allowing to a portion of the cutting edge(s) "TP" or "TE" to be moved against the abrasive surface 7 of the file 5;

means 11 for recovering the filings obtained during the sharpening of the blade "L" , said means 11 being located between said first guiding means 9 and the abrasive surface 7 of the file 5; and means 13 for the selective positioning of said abrasive surface 7 with respect to the cutting edges "TP" of the main portion of the blade 5, between at least two distinct positions, a first of these distinct positions being defined when the cutting edges "TP" of the main portion of the blade "L" are intended to be substantially parallel or tangent to the abrasive surface 7, another of these distinct positions being defined When the cutting edges "TP" of the main portion of the blade "L" may form an angle, in particular an acute angle, with respect to the abrasive surface and that said cutting edges "TE" of one of the end portions may be substantially tangent with at least one portion of the abrasive surface 7, said means 13 comprising:

a removable crutch 15 mounted on the body 3 and provided with second guiding means 17 intended to contact a portion of the cutting edges "TP", said crutch 15 being mounted in a removable way on the body 3 between two distinct positions that is at least one distinct position where the second guiding means 17 are not intended to contact the cutting edges "TP" for allowing to said abrasive surface 7 to be contacted by the cutting edges "TP" in a way substantially parallel or tangent, and at least another distinct position where the second guiding means 17 are intended to be in contact with the cutting edges "TP" while being positioned between the longitudinal axis of the file 5 and the cutting edges "TP" of the main portion of the blade "L" to thus allow to lift one end of the file 5 with respect to the cutting edges "TP" of the main portion of the blade "L" and thus form an angle, in particular acute angle, between them;

means 19 for moving the crutch 15 between one distinct position toward another distinct position;

being understood that when the crutch 15 is positioned in such a way to have its second guiding means 17 between the longitudinal axis of the file 5 and the cutting edges "TP" of the main portion of the blade "L", said second means 17 cooperate with the first guiding means 9 for guiding at least a portion of the cutting edges "TE" of a corresponding end portion of the blade "L" along the abrasive surface 7 of the file 5 and thus sharpen said cutting edges. Referring to FIGS. 1 to 6, it results that the first guiding means may consist for example of two identical rails 10 having a given height, said rails being parallel and at a determined distance from each other and each of rails making an integral part of the bank of the longitudinal slot 2 of the body 3. Preferably, each of rails 10 has at least one intermediate portion 10a of reduced height.

Still referring to FIGS. 1 to 6, it results that the means for recovering the filings may consist for example of another housing 11 located on each side of the longitudinal slot 2 between said first guiding means 9 and the abrasive surface 7 of the housing 4 where is housed the file 5.

Referring to FIGS. 1 to 6, even though it results that the file 5 that may be used consists of a rounded and solid file looking like a cylinder whose the outer cylindrical surface is abrasive (such a file may be for example made of iron or steel), it is understood that this file may be made with all abrasive material and of any appropriate form and size.

Referring to FIGS. 1 to 6, it results that a possible way of fixation of a file in the housing 4 may consist for example of at least one threaded hole 6 and one threaded screw 8. Thus, screws 8 may be screwed in corresponding threaded holes 6 until one end of screws 8 contact the file 5 and press this latter against a floor of the housing 4 where is positioned the longitudinal slot 2.

Preferably, for fastening for example a file 5 in the housing 4, we unscrew screw 8 to allow to the file 5 to be freely introduced in the housing 4 via an opening 4*a* appearing at one end of the housing 4, then once the file in place, we screw screws 8 so that these one engage the file and press it against a floor of the housing 4 where is located the longitudinal slot 2. For withdrawing the file 5 from the housing, we only have to carry out the previous steps in the reverse way. Of course, when the file 5 is worn on one part of its surface, we may merely unscrew screws 8, turn the file 5 on its axis to bring an unworn portion of the surface 7 vis-à-vis the longitudinal slot 2, then screw again screws 8.

Referring to FIGS. 1 to 6, it results that means for moving the crutch 13 between one distinct position and another distinct position may consist for example of a removable sleeve 21 which is mounted in a pivoting way on the body 3, said sleeve 21 being provided with longitudinal slot 23.

Preferably, this sleeve 21 may characterized itself in that the means for moving the crutch from one distinct position to another on the body consist:

of a shoulder 25, at each end of the body 3 and having an outer cylindrical surface 27, a longitudinal slot 2 extending from the one of the body in said shoulder. The outer surface of the shoulder 25 has a longitudinal axis that is substantially co-axial to the main longitudinal axis of the body 3; and an inner cylindrical surface 29 for the sleeve 21; being understood that the inner surface 29 of the sleeve 21 is intended to be mounted in a pivoting way on the surface 27 of either shoulders 25 between at least two distinct positions, that is at least one distinct position where the second guiding means 17 are not positioned between the file 5 and the cutting edges of the main portion of the blade and the slot 23 of the sleeve is aligned with the one of the body 3, so that to allow the cutting edges of the main portion of the blade to contact the abrasive surface 7 of the file 5, and another distinct position where the second guiding means 17 are positioned between the surface 7 of the file 5 and said cutting edges of the main portion of the blade to thus position one end of the file 5 at distance from said cutting edges to thus define an angle, in particular an acute angle, between them.

Preferably, each sleeve may be provided with more than one protuberance, for example three protuberances of different height, each protuberance being provided with second guiding means 17. Preferably, each second guiding means may consist of a groove 17*a*.

Figure 5:
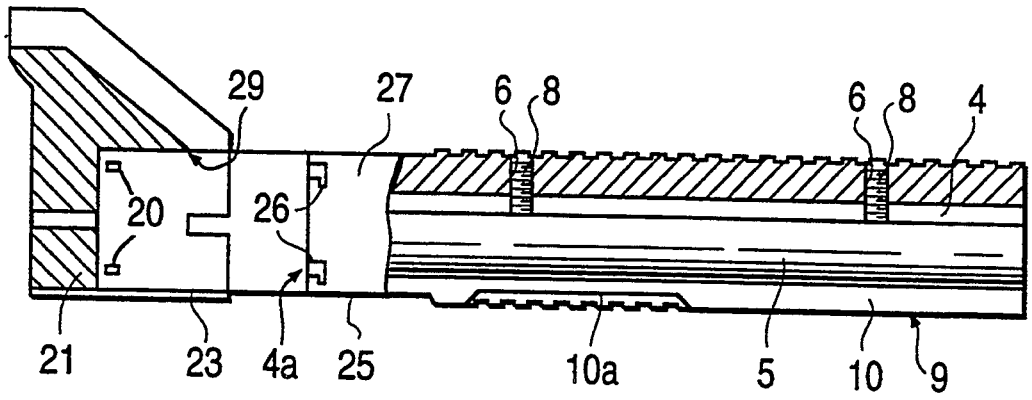
FIG. 5 represents a cross-sectional view according to V—V of the sharpener of FIG. 3.
Figure 6:
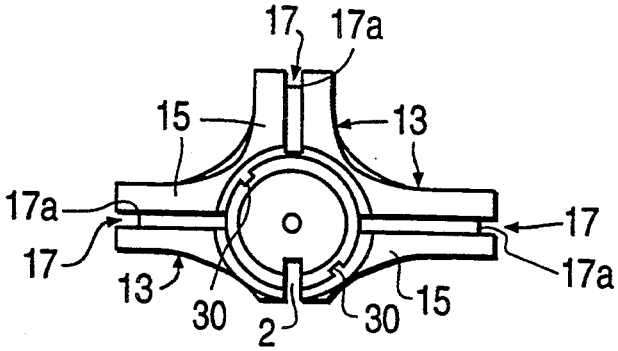
FIG. 6 represents a front elevational view of a sleeve of the sharpener of FIG. 1.

Advantageously, the inner surface 29 of the sleeve 21 and the outer surface of the shoulder 25 may comprise means for locking them one with respect to the other. Preferably, means for locking the sleeve 21 and the shoulder may consist for example of a small protuberance 30 that engages a small corresponding notch 28, as it is illustrated in FIGS. 5 and 6.

To use a sharpener 1, with reference to FIGS. 28 to 30, one must merely carry out the following steps:

1º to manually make the sleeve 21 to pivot on the shoulder 25 until the slot 23 is aligned with the slot 2; alternatively, we may remove the sleeve from the shoulder 25 and put it back with the slot 23 aligned with the slot 2;

2º to hold the sharpener in the hand and insert the blade "L" against the abrasive surface 7 of the file 5 and between the first guiding means 17;

3º to move the abrasive surface 7 against the cutting edges "TP" of the blade "L" while holding the body 3 in one hand of the user;

4º to remove the sharpener 1 from the blade "L", make the sleeve 21 to pivot on the shoulder 25 until the second guiding means 17 of one of the protuberances defining a crutch 13 be positionable between the longitudinal axis of the file 5 and the cutting edges "TP" (preferably the height is chosen so that the file be sensibly tangential to the radius of curvature of cutting edges "TE"); alternatively, we may remove the sleeve 21 from the shoulder 25 and put it back in the orientation sought for;

5º to reinsert the blade "L" against the abrasive surface 7 between the second and first guiding means 9 and 17, the guiding means 9 being located on both sides of lateral faces of one of the end portions of the blade "L" while the guiding means 17 are positioned on both sides of lateral faces of the main portion of the blade "L";

6º to move the abrasive surface 7 against the cutting edges "TE" while holding the body 3 in the hand of the user; and 7º to start again the previous steps until the obtention of the sharpening sought for.

Of course, steps 5º and 6º may be repeated for increasing height of crutches 13 when necessary, in particular when the radius of curvature of cutting edges "TE" are of such a size that we can only sharpen a segment of cutting edges "TE" for a given height of crutch 13.

The body 3, rails 10 and 10*a*, the sleeve 21 and the crutches 13 may be made of any appropriate material, such as for example with mouldable plastic material.

Referring to FIGS. 1*a* to 6*a*, we describe therein a first variant of the portable sharpener making the object of FIGS. 1 to 6. This portable sharpener 101 is intended to be used for blades of the same type than those defined for the portable sharpener of FIGS. 1 to 6 and in particular for a blade "L'" of the type comprising a main portion provided with two cutting edges parallel and slightly curved "TP'" and two end portions each provided with two cutting edges "TE'", and, preferably, the blade is the one of a hockey skate. This sharpener 101 differs from the sharpener of FIGS. 1 to 6 in that the crutch 115 may be mounted in a removable way on the body at either end thereof to allow the abrasive surface 107 of the file 105 to sharpen the cutting edges "TE'" and "TP'" of the blade "L'" in a same direction.

This sharpener 101 comprises a body 103 having a main longitudinal axis, a housing 104 and including:

a file 105 having a longitudinal axis and at least one abrasive surface 107 parallel to said longitudinal axis and to the longitudinal axis of the body;

means for fastening the file 105 in the housing 104;

first guiding means 109 for allowing to a portion of the cutting edge (s) "TP'" or "TE'" to be moved against the abrasive surface 107 of the file 105;

means 111 for recovering the filings obtained during the sharpening of the blade "L'" said means 111 being located between said first guiding means 109 and the abrasive surface 107 of the file 105; and means 113 for the selective positioning of said abrasive surface 107 with respect to the cutting edges "TP'"of the main portion of the blade 105, between at least two distinct positions, a first of these distinct positions being defined when the cutting edges "TP'" of the main portion of the blade "L'" are intended to be substantially parallel or tangent to the abrasive surface 107, another of said distinct positions being defined when the cutting edges "TP'" of the main portion of the blade "L'" may form an angle, in particular an acute angle, with respect to the abrasive surface and that said cutting edges "TE'" of one of the end portions may be substantially tangent with at least one portion of the abrasive surface 107, said means 113 comprising:

a removable crutch 115 mounted on the body 103 and provided with second guiding means 117 intended to contact a portion of the cutting edges "TP'", said crutch 115 being mounted in a removable way on the body 103 between two distinct positions, that is at least one distinct position where the second guiding means 117 are not intended to contact the cutting edges "TP'" for allowing to said abrasive surface 107 to be contacted by cutting edges "TP'" in a way substantially parallel or tangent, and at least another distinct position where the second guiding means 117 are intended to be in contact with the cutting edges "TP'" while being positioned between the longitudinal axis of the file 105 and the cutting edges "TP'" of the main portion of the blade "L'" to thus allow to lift one end of the file 105 with respect to the cutting edges "TP'" of the main portion of the blade "L'" and thus form an angle, in particular an acute angle, between them;

means 119 for moving the crutch 115 between one distinct position toward another distinct position;

being understood that when the crutch 115 is positioned in such a way to have its second guiding means 117 between the longitudinal axis of the file 105 and the cutting edges "TP'" of the main portion of the blade "L'" said second means 117 cooperate with the first the guiding means 109 for guiding at least a portion of the cutting edges "TE'" of a corresponding end portion of the blade "L'" along the abrasive surface 107 of the file 105 and thus sharpen said cutting edges.

Referring to FIGS. 1*a* to 6*a*, it results that the first guiding means may consist of two identical rails 110 having a given height, said rails 110 being parallel and at a determined distance from each other and each rails 110 making an integral part of the bank of the longitudinal slot 102 of the body 103. Preferably, each of rails 110 has two intermediary portions 110*a* of reduced height.

Still referring to FIGS. 1*a* to 6*a*, it results that means for recovering the filings may consist for example of another housing 111 on each side of the longitudinal slot 102 between said first guiding means 109 and the abrasive surface 107 of the housing 104 where is housed the file 105.

Referring to FIGS. 1*a* to 6*a*, even though it results that the file 105 that may be used consist of a rounded and solid file looking like a cylinder whose the cylindrical outer surface is abrasive (this file may be for example made of iron or steel), it is understood that this file may be made of all abrasive material and of all appropriate form or size.

Referring to FIGS. 1*a* to 6*a*, it results that a possible way of fixation of a file in the housing 104 may consist for example of at least one threaded hole 106 and one threaded screw 108. Thus, screws 108 may be screwed in corresponding threaded holes 106 until one end of screws 108 contact the file 105 and press this latter against a floor of the housing 104 where is positioned the longitudinal slot 102.

Preferably, for fastening a file 105 in the housing 104, we unscrew screws 108 to allow to the file 105 to be freely introduced in the housing 104 via an opening 104*a* appearing at one end of the housing 104, then once the file in place, we screw screws 108 so that these one engage the file and press it against a floor of the housing 104 where is located the longitudinal slot 102. For withdrawing the file 105 from the housing, we only have to carry out the previous steps in the reverse way.

Referring to FIGS. 1*a* to 6*a*, it results that means for moving the crutch 115 between one distinct position and another distinct position may consist for example in a removable sleeve 121 which is mounted in a pivoting way on the body 103, said sleeve 121 being provided with longitudinal slot 123.

Preferably, this sleeve 121 may characterize itself in that means for moving the crutch from one distinct position to another on the body consist:

of a shoulder 125, at each end of the body 103 and having an outer cylindrical external surface 127, a longitudinal slot 127*a* extending from the one of the body in said shoulder. The outer surface of the shoulder 125 has a longitudinal axis that is substantially co-axial to the main longitudinal axis of the body 103; and an inner cylindrical surface 129 for the sleeve 121;

being understood that the inner surface 129 of the sleeve 121 is intended to be mounted in a pivoting way on the surface 127 of either shoulders 125 between at least two distinct positions, that is at least one distinct position where the second guiding means 117 are not positioned between the file 105 and the cutting edges of the main portion of the blade and the slot 123 of the sleeve is aligned with the one of the body 103, in a way to allow the cutting edges of the main portion of the blade to contact the abrasive surface 107 of the file 105, and another distinct position where the second guiding means 117 are positioned between the surface 107 of the file 105 and said cutting edges of the main portion of the blade to thus position one end of the file 105 at distance from said cutting edges to thus define and angle, in particular an acute angle, between them.

Preferably, each sleeve may be provided with more than one protuberance 113, for example three protuberances of different heights, each protuberance being provided with second guiding means 117. Preferably, each of the second guiding means 117 may consist of a groove 117*a*.

Figure 5A:
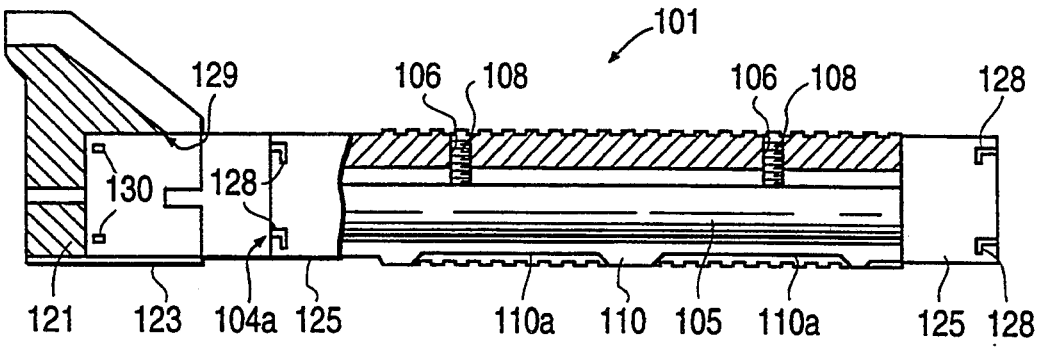
FIG. 5*a* represents a cross-sectional view according to V—V of the sharpener of FIG. 3*a;*
Figure 6A:
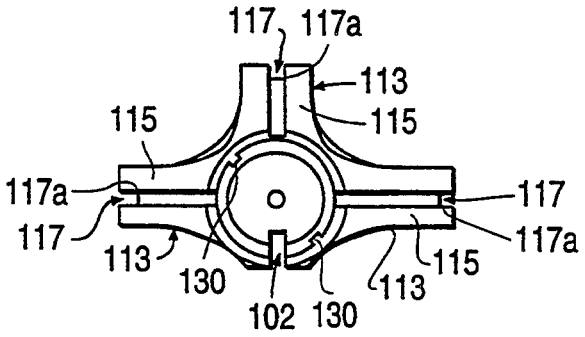
FIG. 6*a* represents a front elevational view of the sleeve of the sharpener of FIG. 1*a;*
Figure 7:
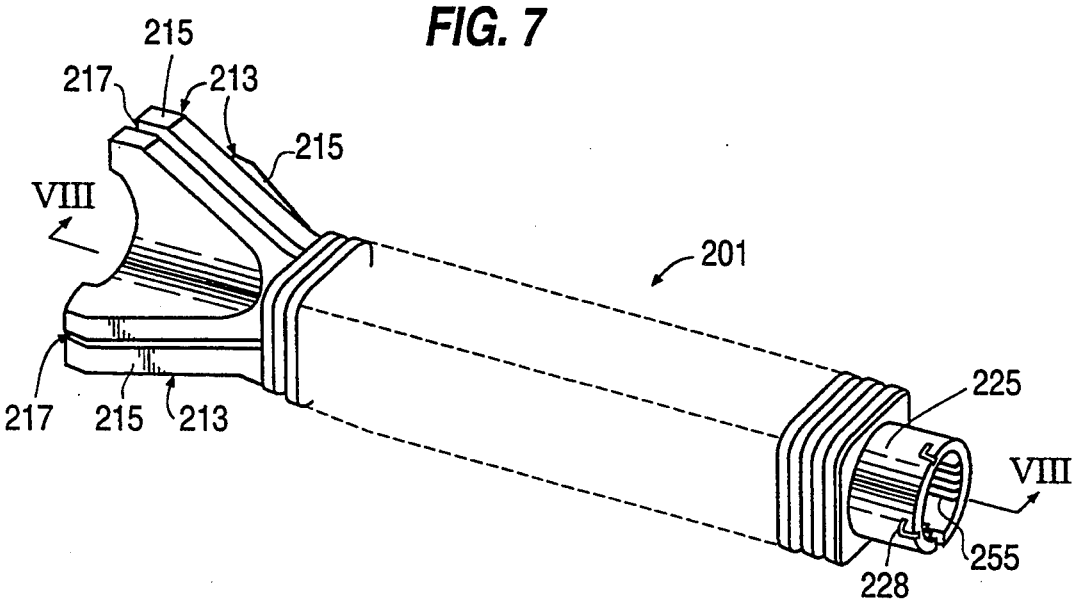
FIG. 7 represents a perspective view of the underneath of a second variant of the sharpener of FIG. 1.

Advantageously, the inner surface 129 of the sleeve 121 and the outer surface of the shoulder 125 may comprise means for locking them one with respect to the other. Preferably, means for locking the sleeve 121 and the shoulder may consist for example of a small protuberance 130 that engages a small corresponding notch 128, as this is illustrated in FIGS. 5*a* and 6*a*.

For using a sharpener 101, with reference to FIGS. 28*a* to 30*a*, one must merely carry out the following steps:

1º to make the sleeve 121 to pivot on the shoulder 125 until the second guiding means 117 of one of the protuberances defining a crutch 113 be positionable between the longitudinal axis of the file 105 and the cutting edges "TP'" (preferably the height of the crutch is chosen so that the file be sensibly tangential to the radius of curvature of the cutting edges "TE'"); alternatively, it may be possible to withdraw the sleeve 121 from the shoulder 125 for repositioning it on said shoulder with the second guiding means 117 in another orientation;

2º to insert the blade "L'" against the abrasive surface 107 and between the first and the second guiding means 109 and 117, the guiding means 109 being located on both side of lateral faces of one of end portions of the blade "L'" while the guiding means 117 are positioned on both sides of the lateral faces of the main portion of the blade "L'";

3º to move the abrasive surface 107 against the cutting edges "TE'" while holding the body 103 in the hand of the user;

4º to remove the sharpener 101 from the blade "L'" to make the sleeve 121 to pivot on the shoulder 125 until the slot 123 is aligned with the slot 102;

5º to hold the sharpener in hand and insert the blade "L'" against the abrasive surface 107 of the file 105 and between the first guiding means 117;

6º to move the abrasive surface 107 against the cutting edges "TP'" of the blade "L'" while holding the body 103 in the hand of the user;

7º to withdraw the sharpener 101 from the blade "L'", to withdraw the sleeve 121 from the shoulder 125 and to remount it at the other end, to make the sleeve 121 to pivot on the shoulder 125 until the second guiding means 117 of one of protuberances defining a crutch 115 be positionable between the longitudinal axis of the file 105 and cutting edges "TP'" (preferably the height of the crutch is chosen so that the file be sensibly tangential to the radius of curvature of cutting edges "TE'");

8º to reinsert the blade "L'" against the abrasive surface 107 between the first and second guiding means 109 and 117, the guiding means 109 being located on both sides of lateral faces of one of end portions of the blade "L'" while the guiding means 117 are positioned on both sides of lateral faces of the main portion of the blade "L'";

9º to move the abrasive surface 107 against the cutting edges "TE'" while holding the body 103 in one hand of the user; and 10º to start again the previous steps until the obtention of the sharpening sought for.

Of course, the 2º and 3º and 8º and 9º steps may be repeated for increasing height of crutches 115 when necessary, in particular when the radius of curvature of cutting edges "TE'" are of such a size that we can only sharpen a segment of said cutting edges "TE'" for a given height of crutch 115.

The body 103, rails 110 and 110*a*, the sleeve 121 and the crutches 115 may be made of any appropriate material, such as for example with mouldable plastic material.

Referring to FIGS. 7 to 16, it is represented a second variant of sharpener according to the invention. This sharpener 201 is similar to the sharpener 101 except for what is concerned with fixation means of the file 205 inside the housing 204. Indeed, holes 106 and screws 108 of the sharpener 101 are replaced in the sharpener 210 by a tongue 251 provided with lateral edges 253 and intended to engage corresponding grooves 255 provided in the lateral walls 257 of a housing 204 where is housed the file 205, to thus press the file 205 against a floor of said housing 204 and against the longitudinal slot 202. Of course, if the diameter of the file is such that it is sensibly the same than the distance separating the floor and the ceiling of the housing 204, the use of the tongue may be omitted.

For fixing a file 205 inside a housing 204, just introduce the file 205 by the opening 204*a*, then make the lateral edges 253 to slide in corresponding grooves 255 for maintaining the file on the floor of the housing 204 where the longitudinal slot 202 is located. For withdrawing the file 205 from the housing 204, just carry out the previous steps in the reverse way.

Figure 8:
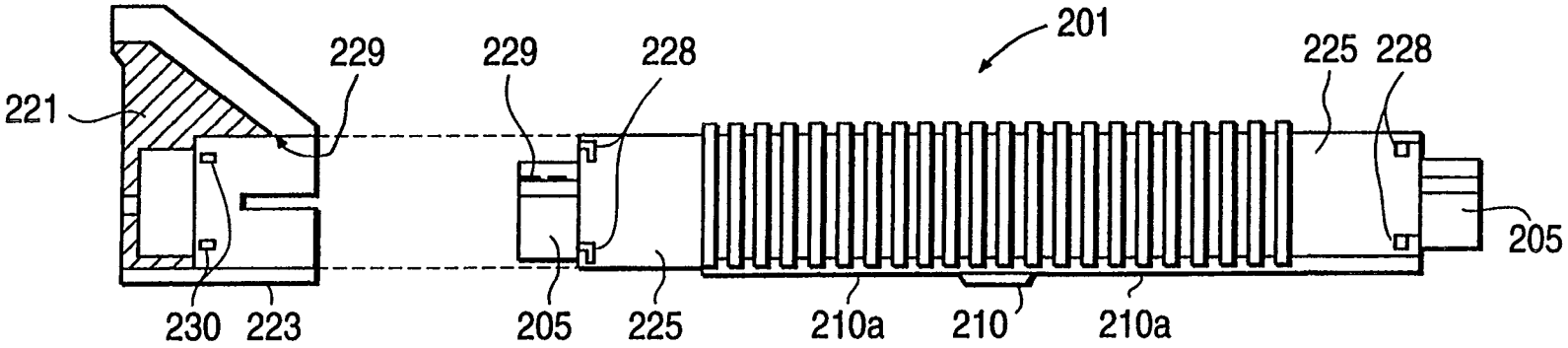
FIG. 8 represents a cross-sectional and exploded view according to VIII—VIII of the sharpener of FIG. 7.
Figure 9:
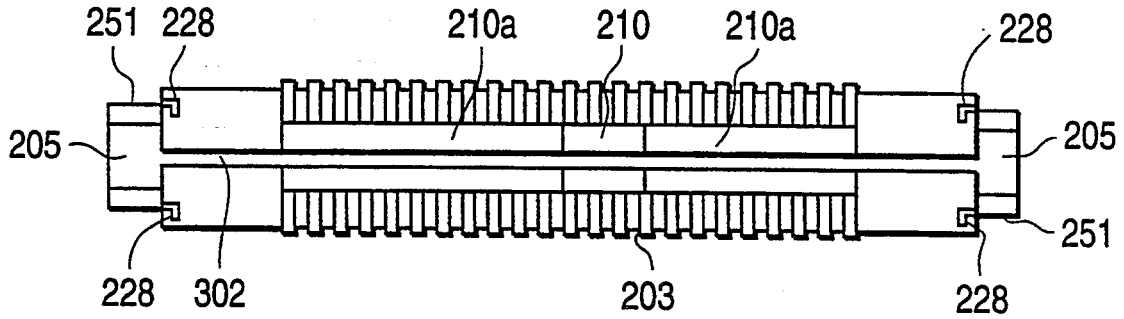
FIG. 9 represents an underneath view of the sharpener of FIG. 7.
Figure 10:
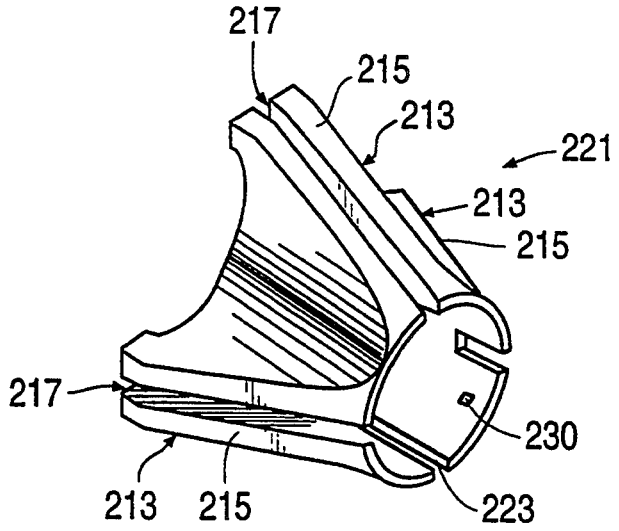
FIG. 10 represents a perspective view of a sleeve of the sharpener of preceding figures where appear protuberances defining crutches.
Figure 11:
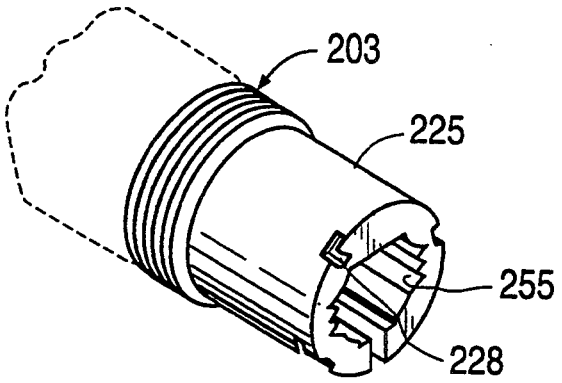
FIGS. 11 and 12 represent a variant of the way of fixation of the file inside the body of the sharpener, as the one used for the sharpener of FIGS. 7 to 9.
Figure 12:
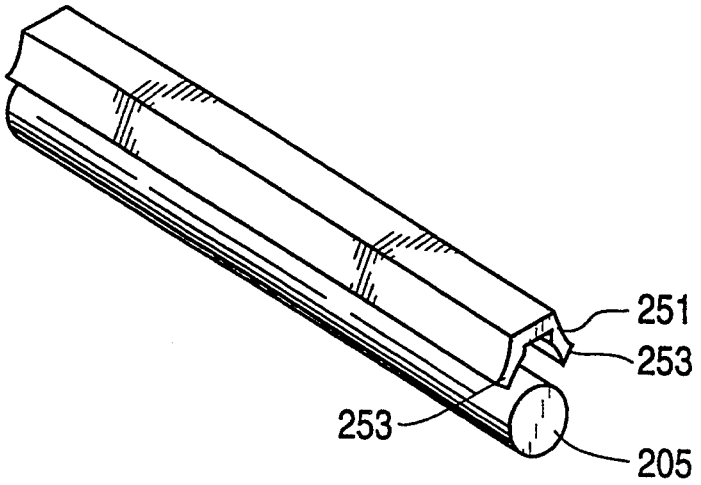
Figure 13:
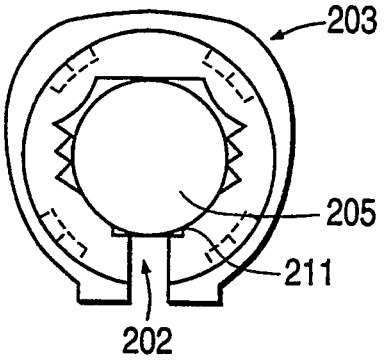
Figure 14:
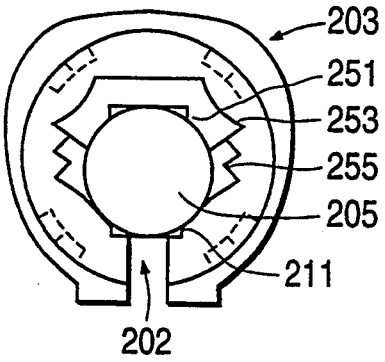
Figure 15:
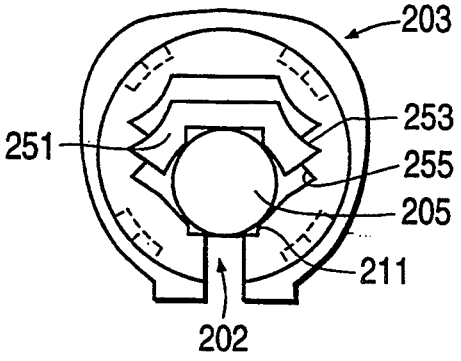
Figure 16:
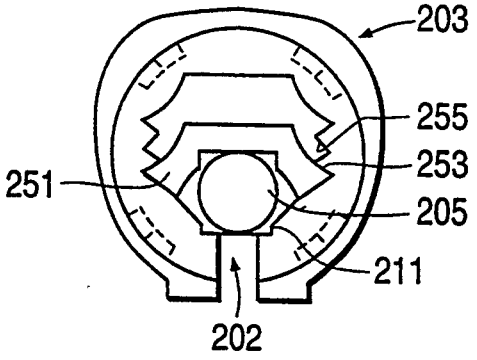

Furthermore, as illustrated in FIGS. 8 and 9, the file 205 and tongue 251 may be of a length superior to the one of the housing 204. In such a case, which is purely optional, the sleeve 221 may present a housing of appropriate configuration.

The other structural characteristics of the sharpener 201 as well as its method of use, are similar to what has been defined for the sharpening 101, except all the reference numbers have incremented by 100.

Figure 18:
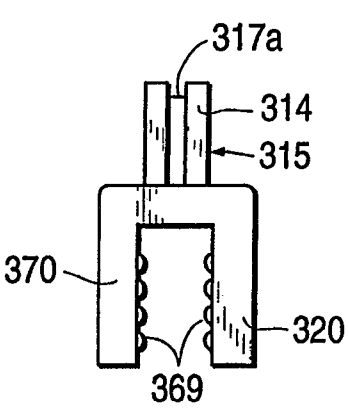
FIG. 18 represents an underneath perspective view of a the sharpener of FIG. 17.
Figure 17:
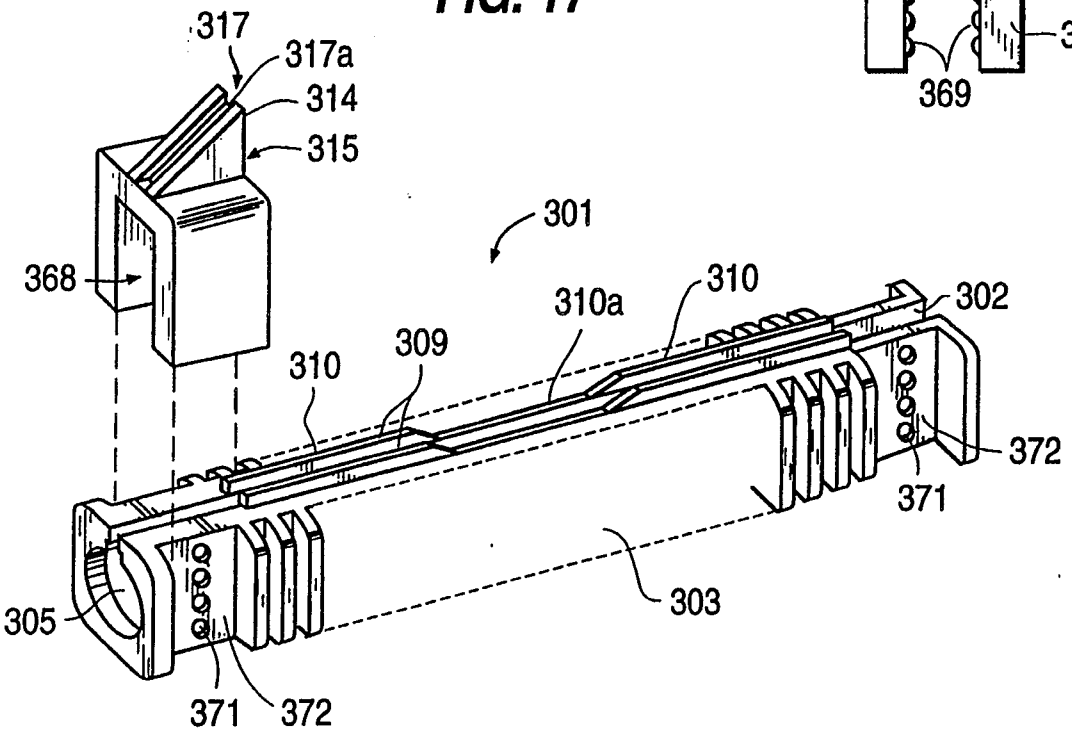
FIG. 17 represents an underneath perspective view of a third variant of sharpener according to the invention.

Referring to FIGS. 17 and 18, we now proceed to the description of a third variant of sharpener according to the invention. This sharpener 301 differs from previous sharpener is that the crutch 315 comprises a wedge shaped portion 314 that is provided with a slot 317*a* defining the second guiding means 317 and a U shaped portion 368 that is provided with small protuberances 369 inside of each of its branches 370. Said small protuberances 369 are intended to engage a corresponding small cavity 371 provided inside notches 372 located in each of ends of the body 303. The second guiding means 317 may be positioned between the file 305 and the cutting edges of the main portion of the blade when the wedge shaped portion 314 is positioned above the longitudinal slot 302 of the body 303, said second guiding means 317 being not intended to be in contact with the cutting edges when the opening of the U shaped portion is on the same side than the one where appears the longitudinal slot of the body 303.

The other structural characteristics of the sharpener 301 are similar to what has been defined for the sharpener 201 except the rails 210 only comprise one area 210*a* and that all reference numbers have incremented by 100.

For using a sharpener 301, with reference to FIGS. 28*b* to 30*b*, one must merely carry out the following steps:

1º to make the "U" shaped portion 368 to slide along notches 372 until small protuberances 369 engage corresponding small cavities 371 and that the second guiding means 317 of the crutch 315 is positionable between the longitudinal axis of the file 305 and the cutting edges "TP'" (preferably the height of the crutch is chosen by selecting the position of small protuberances 369 in small cavities 371 in order that the file be sensibly tangent to the radius of curvature of the cutting edges "TE'");

2º to insert the blade "L'" against the abrasive surface 307 and between the first and the second guiding means 309 and 317, the guiding means 309 being located on both side of lateral faces of one of end portions of the blade "L'" while the guiding means 317 are positioned on both sides of the lateral faces of the main portion of the blade "L'";

3º to move the abrasive surface 307 against the cutting edges "TE'" while holding the body 303 in the hand of the user;

4º to remove the sharpener 301 from the blade "L'", to make the "U" shaped portion 368 to slide along notches 372 to remove said portion 368 from the notch 372, then to make said portion 368 to slide along notches 372 to position second guiding means 309 at the opposite of the longitudinal slot 302;

5º to hold the sharpener in hand and insert the blade "L'" against the abrasive surface 307 of the file 305 and between the first guiding means 317;

6º to move the abrasive surface 307 against the cutting edges "TP'" of the blade "L'" while holding the body 303 in the hand of the user;

7º to remove the sharpener 301 from the blade "L'", to make the "U" shaped portion 368 to slide along notches 372 until small protuberances 369 engage corresponding small cavities 371 and that the second guiding means 317 of one crutch 315 be positionable between the longitudinal axis of the file 305 and the cutting edges "TP'" (preferably the height of the crutch is chosen by selecting the position of small protuberances 369 in small cavities 371 in order that the file be sensibly tangent to the radius of curvature of the cutting edges "TE'");

8º to reinsert the blade "L'[ against the abrasive surface 307 between the first and second guiding means 309 and 317, the guiding means 309 being located on both sides of lateral faces of one of end portions of the blade "L'" while the guiding means 317 are positioned on both sides of lateral faces of the main portion of the blade "L'";

9° to move the abrasive surface 307 against the cutting edges "TE'" while holding the body 303 in one hand of the user; and 10° to start again the previous steps until the obtention of the sharpening sought for.

Of course, the 2° and 3° and 8° and 9° steps may be repeated for increasing height of crutches 315 when necessary, in particular when the radius of curvature of cutting edges "TE'" are of such a size that we can only sharpen a segment of cutting edges "TE'" for a given height of crutch 315.

The body 303, the rails 310 and 310*a*, the "U" shaped member 368 and the crutches 315 may be made of any appropriate material, such as for example with mouldable plastic material.

Figure 19:
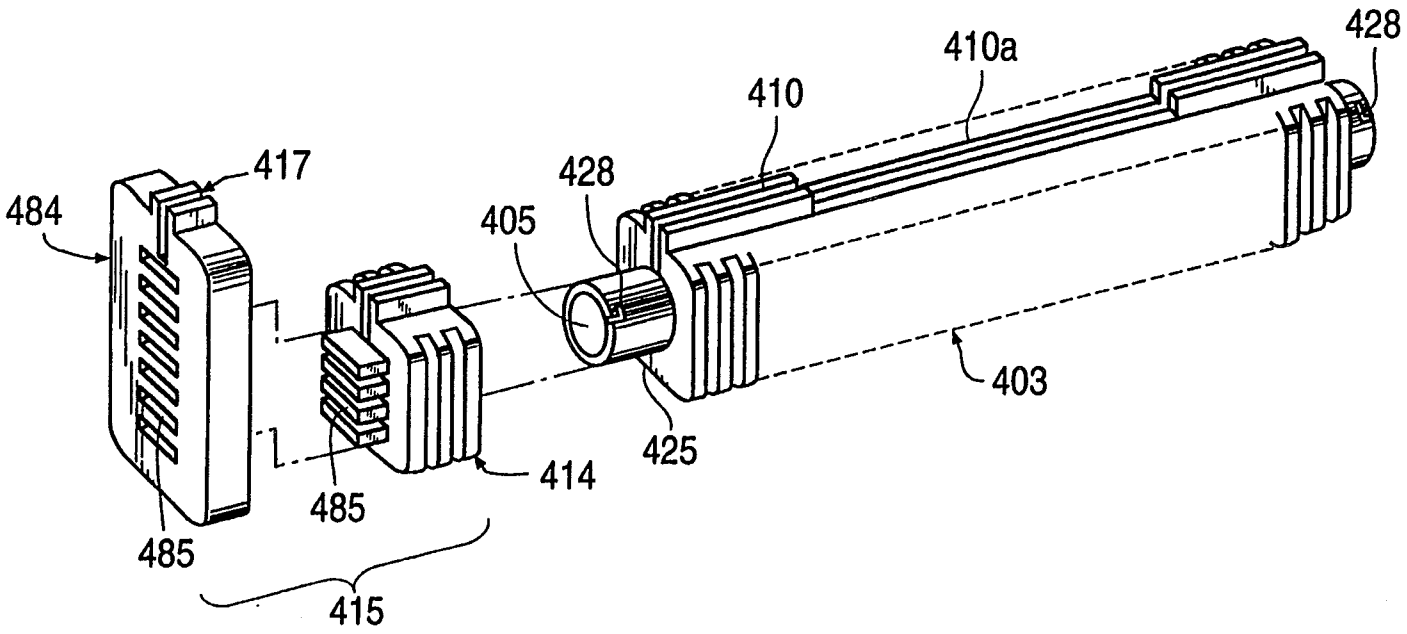
FIG. 19 represents a perspective view of a forth variant of sharpener according to the invention.

Referring to FIG. 19, we now proceed with the description of a fourth variant of sharpener according to the invention. This sharpener 401 differs from sharpener previously defined in that the crutch 415 consists of a removable button 414 mounted on the body 403 and provided with members 484 having opposite ends and showing at one of its ends said second guiding means 417, said member 484 being fastened in a removable way to the button 414 by a tongue and groove assembly 485 said second guiding means 417 being positioned between the longitudinal axis of the file 405 and the cutting edges of the main portion of the blade when the button 414 is mounted at either ends of the body 403, said second guiding means 471 being not in contact with said body 403 when the button 414 is removed from the body 403. The number of grooves is preferably higher than the one of tongue, to allow an adjustment of the height of the member 484 with respect to the button 414.

The other structural characteristics of the sharpener 401 are similar to what has been defined for the sharpener 301 except all reference number have been incremented by 100.

For using a sharpener 401, with reference to FIGS. 28*c* to 30*c*, one must merely carry out the follow steps:

1° to make the button 414 to pivot on the shoulder 425 for aligning the slot 414a with the slot 402 and until the second guiding means 417 are positionable between the longitudinal axis of the file 405 and the cutting edges "TP'" the member 484 having been fastened to the button by a tongue and groove assembly 485 (preferably the height of the crutch is selected so that the file is sensibly tangential to the radius of curvature of the cutting edges "TE'");

2° to insert the blade "L'" against the abrasive surface 407 and between the first and the second guiding means 409 and 417, said guiding means 409 being located on both side of lateral faces of one of end portions of the blade "L'" while the other guiding means 417 are positioned on both sides of the lateral faces of the main portion of the blade "L'";

3° to move the abrasive surface 407 against the cutting edges "TE'" while holding the body 403 in one hand of the user;

4° to move the member 484 of the button 414 then reposition it on the member 414 in an orientation where the second guiding means cannot contact the cutting edges of the blade, for example by orienting said second guiding means 417 at the opposite of the longitudinal slot 402;

5° to hold the sharpener in hand and insert the blade "L'" against the abrasive surface 407 of the file 405 and between the first guiding means 409;

6° to move the abrasive surface 407 against the cutting edges "TP'" of the blade "L'" while holding the body 403 in one hand of the user;

7° to remove the sharpener 401 from the blade "L'", to remove the button 414 from the shoulder 425 then to remount it at the other end, to remove the member 484 from the button 414 and for having the second guiding means be positionable between the longitudinal axis of the file 405 and the cutting edges "TP'" to insert the member 484 on the button by assembling of the type tongue and groove (preferably the height of the crutch is selected so that the file be sensibly tangential to the radius of curvature of the cutting edges "TE'");

8° to reinsert the blade "L'" against the abrasive surface 407 between the first and second guiding means 409 and 417, the guiding means 409 being located on both sides of lateral faces of one of end portions of the blade "L'" while the guiding means 417 are positioned on both sides of lateral faces of the main portion of the blade "L'";

9° to move the abrasive surface 407 against the cutting edges "TE'" while holding the body 403 in one hand of the user; and 10° to start again the previous steps until the obtention of the sharpening sought for.

Of course, the 2° and 3° and 8° and 9° steps may be repeated for increasing height of crutches 415 when necessary, in particular when the radius of curvature of the cutting edges "TE'" are of such a size that it can only sharpen a segment of cutting edges "TE" for a given height of crutch 415.

The body 403, the sleeve 421 and the crutches 415 may be made of any appropriate material, such as for example with mouldable plastic material.

Figure 20:
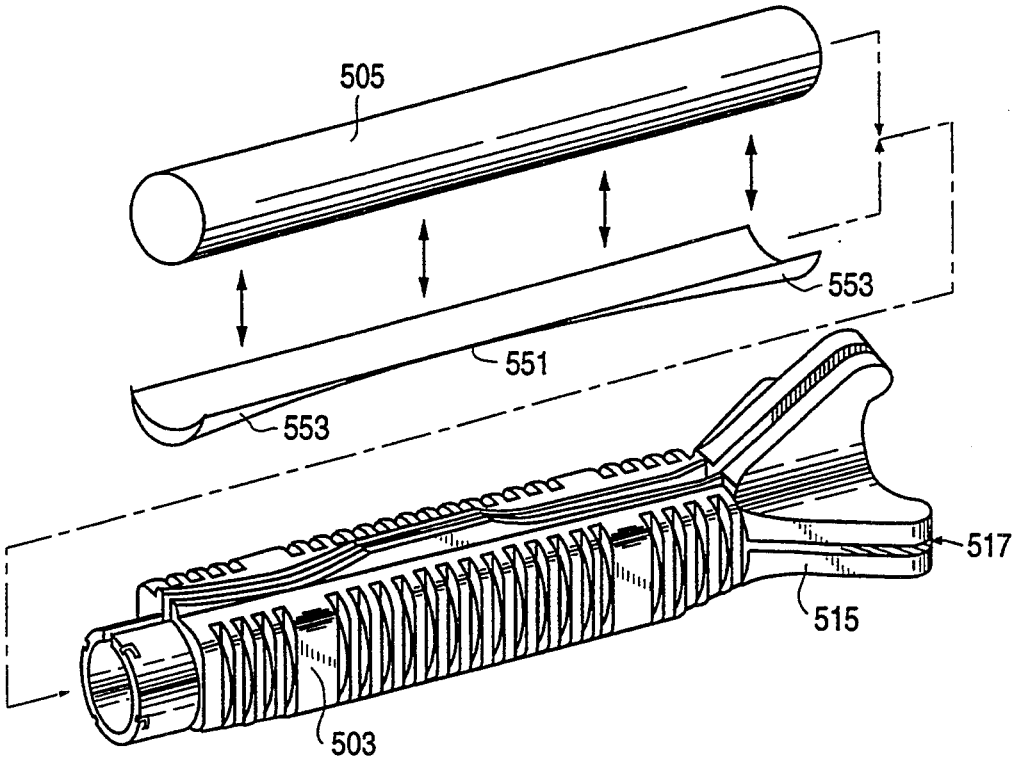
FIG. 20 represents an exploded view of a fifth variant of sharpener according the invention.
Figure 21:
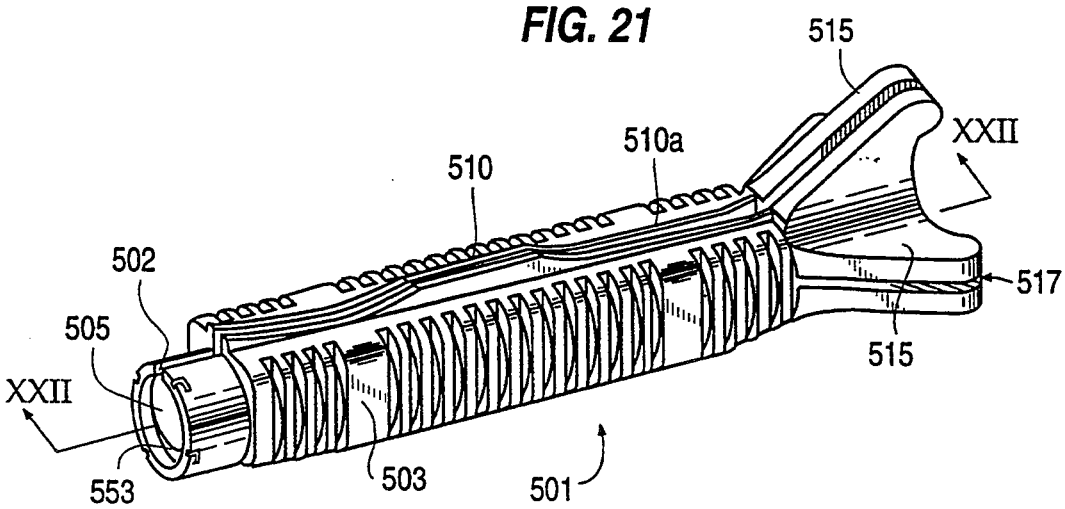
FIG. 21 represents a perspective view of the fifth variant of the invention.
Figure 22:
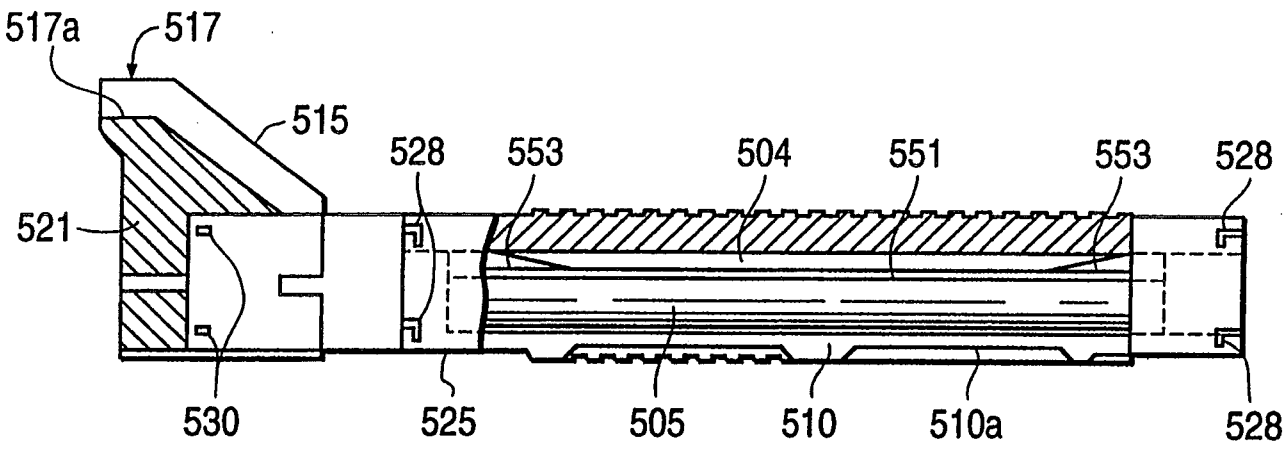
FIG. 22 represents a cross-sectional and exploded view according to XXII—XXII of a fifth variant of sharpener according to the invention.

Referring to FIGS. 20 to 21, it will be described now a fifth variant of sharpener according to the invention. This sharpener 501 is identical to the one of the first variant of sharpener 101 which is illustrated in figures la to 6a and 28*a* to 30*a*, except for the fixation way of the file in the housing 504.

Indeed, as it is illustrated in particular the fastening means may consist of a blade 551 provided with protuberance 553 at each of its ends. The protuberances 553 are of height slightly superior to the distance that may separate the top of the file 505 from the ceiling of a housing 504 inside of which the file is housed for thus pressing the file against a floor 555 of said housing and against the longitudinal slot 502.

For fastening a file 505 in a housing 504, we introduce under pressure said file 505 by the opening 504*a* of the housing 504 at the same time we introduce the blade 551. The distance between the ceiling and the floor of the housing 504 being lesser that the height resulting from the diameter of the file 505 and the protuberance 553, the friction will maintain in place the file in the housing 504. For removing the file 505 from the housing 505, just carry out the above mentioned steps in the reverse way. The blade may be made of any appropriate material, in particular of plastic material.

The other structural characteristics of the sharpener 501 as well as its method of use, are similar to what has been defined for the sharpener 201 except all reference numbers have incremented by 300.

Figure 23:
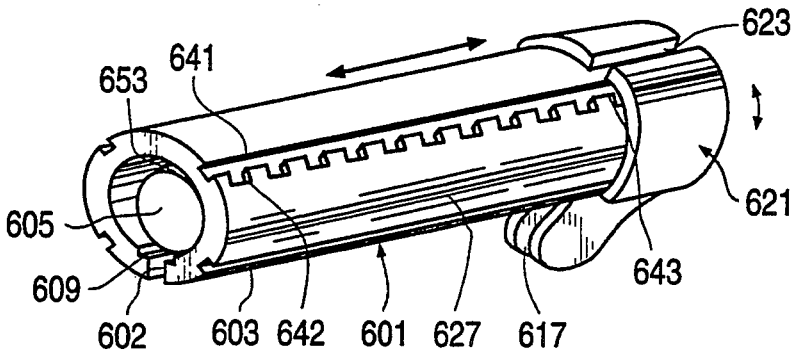
FIG. 23 represents a perspective view of a sixth variant of the invention.
Figure 24:
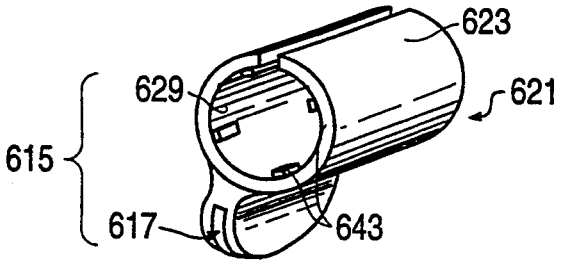
FIG. 24 represents a perspective view of the sleeve of the sixth variant of the invention.
Figure 25:
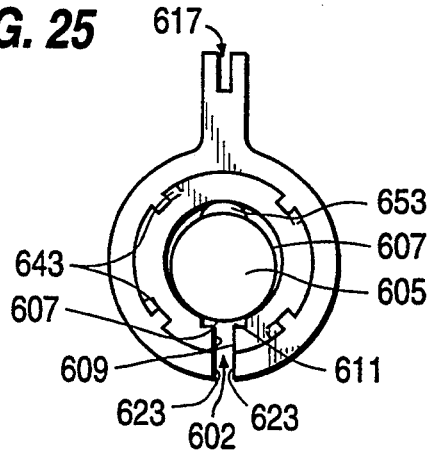
FIG. 25 represents an end view of the sixth variant of the invention.

Referring to FIGS. 23 to 25, it will be described now a sixth variant of sharpener according to the invention. Those figures show a sharpener 601 that differs from sharpener previously defined in that the crutch 615 consist of a sleeve 621 that is mounted in a removably and pivoting way on the body 603, said sleeve 621 being provided with a longitudinal slot 623; and characterized in that said means for moving the crutch 615 from one distinct position to another consist of:

an outer cylindrical surface 627 for the body 603 and an inner cylindrical surface 629 for the sleeve 621;

being understood that the inner surface 629 of the sleeve 621 is intended to be mounted in a pivoting way on the outer surface 627 of the body 603, said sleeve 621 being movable by pivotment between two distinct positions, that is at least one distinct position where the second guiding means 617 are not positioned between the file 605 and the cutting edges of the main portion of the blade and the slot 623 of the sleeve is aligned with the slot 602 of the body, so as to allow the cutting edges of the main portion of the blade to be in contact with the surface 607 of the file 605, and another distinct position where the second guiding means 617 are positioned between the abrasive surface 607 of the file 605 and said cutting edges of the main portion of the blade to thus position one end of the file 605 at a given distance from said cutting edges in order to create an angle, in particular an acute angle, between them; and said sleeve 621 being movable by sliding from one end to another of said body 603, along said body 603 to thus allow to modify the value of the angle that may define the file 605 with respect to the main portion of the blade.

According to a particularly preferred aspect of this sixth variant of sharpener according to the invention, the outer surface 627 of the body 603 is further provided with at least one guiding notch 641 and that the inner surface 629 of the sleeve 621 is further provided with a protuberance 643 intended to engage said corresponding guiding notch 641. According to a particularly preferred aspect of this sixth variant of sharpener, the outer surface 627 of the body 603 may be provided with several notches 641 (for example 4) and, furthermore, according to a particularly preferred aspect, each notches 641 may be provided with means, for example small notches 642 adapted to cooperate with one corresponding protuberance 643 to removably lock the sleeve 621 along the body 603. Of, course, a protuberance 643 is removed from its corresponding guiding notch 641 before pivoting the sleeve 621 on the surface 627.

For using a sharpener 601, with reference to FIGS. 28*d* to 30*d*, on must merely carry out the following steps:

1º to make the sleeve 621 to pivot on the outer surface 627 of the body 603 until the second guiding means 617 of the crutch 615 be positionable between the longitudinal axis of the file 605 and the cutting edges "TP'" (preferably the height of the crutch is chosen so that the file is sensibly tangential to the radius of curvature of the cutting edges "TE'");

2º to insert the blade "L'" against the abrasive surface 607 and between the first and the second guiding means 609 and 617, the guiding means 609 being located on both side of lateral faces of one of end portions of the blade "L'" while the guiding means 617 are positioned on both sides of the lateral faces of the main portion of the blade "L'";

3º to move the abrasive surface 607 against the cutting edges "TE'" while holding the body 603 in one hand of the user;

4º to remove the sharpener 601 from the blade "L'", to remove protuberances 643 from notches 642 and guiding means 641 and make the sleeve 621 to pivot with respect to the outer surface 627 of the body 603 until the slot 623 is aligned with the slot 602 and then reintroduce protuberances 643 in corresponding guiding grooves 641 and notches 642;

5º to hold the sharpener in hand and insert the blade "L'" against the abrasive surface 607 of the file 605 and between the first guiding means 609;

6º to .move the abrasive surface 607 against the cutting edges "TP'" of the blade "L'" while holding the body 603 in one hand of the user;

7º to remove the sharpener 601 from the blade "L'", to slide the sleeve 121 along the outer surface 627 toward the opposite end of the body then remove protuberances 643 from notches 642 and guiding means 641 and make the sleeve 621 to pivot with respect to the outer surface 627 of the body 603 until the second guiding means 617 of the crutch 615 are positionable between the longitudinal axis of the file 605 and the cutting edges "TP'" (preferably the height of the crutch is chosen so that the file be sensibly tangential to the radius of curvature of the cutting edges "TE'") and then reintroduce protuberances 643 in corresponding guiding grooves 641 and notches 642;

8º to reinsert the blade "L'" against the abrasive surface 607 between the first and second guiding means 609 and 617, the guiding means 609 being located on both sides of lateral faces of one of end portions of the blade "L'" while the guiding means 617 are positioned on both sides of lateral faces of the main portion of the blade "L'";

9º to move the abrasive surface 607 against the cutting edges "TE'" while holding the body 603 in one hand of the user; and 10º to start again the previous steps until the obtention of the sharpening sought for.

Of course, the 2º and 3º and 8º and 9º steps may be repeated for increasing height of crutches 615 when necessary, in particular when the radius of curvature of cutting edges "TE'" are of such a size that we can only sharpen a segment of cutting edges "TE'" for a given height of crutch 615.

The body 603, the guiding means 609, the sleeve 621 and the crutch 615 may be made of any appropriate material, such as for example with moulable plastic material. Furthermore, this file 605 may be locked inside the body 603 with a blade having protuberances 653. This blade is similar to the one illustrated in FIGS. 20 and 21. Also, means 611 similar to means 11 are provided to recover fillings obtained during the sharpening.

The file may be of any type previously defined.

Figure 26:
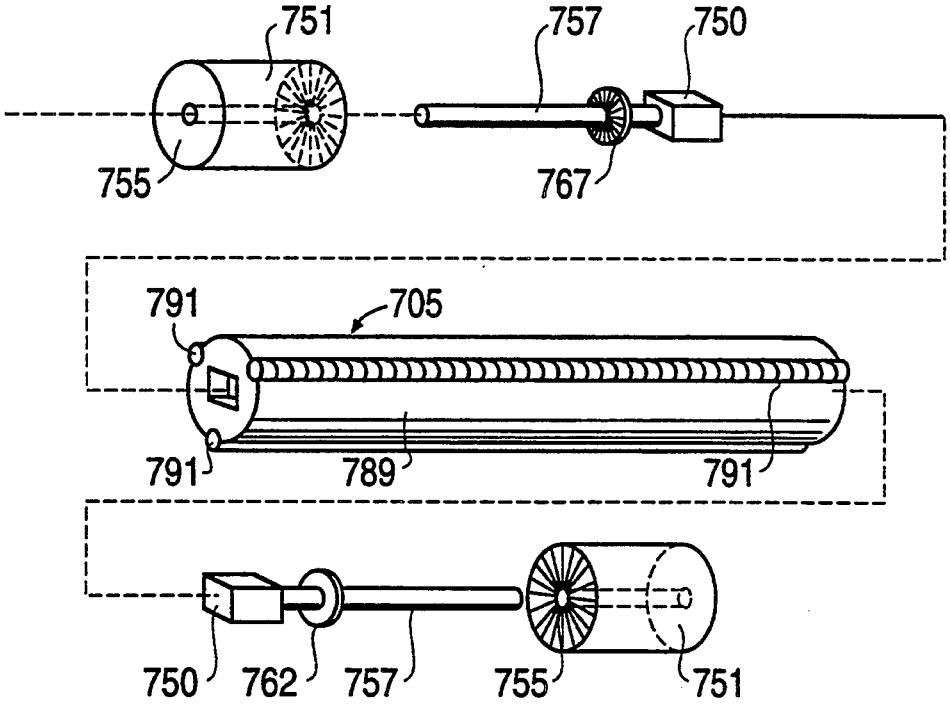
FIGS. 26 and 27 represent an optional way for positioning a plurality of files mounted on a pivoting support inside the body of a sharpener according to any aspects of the invention.
Figure 27:
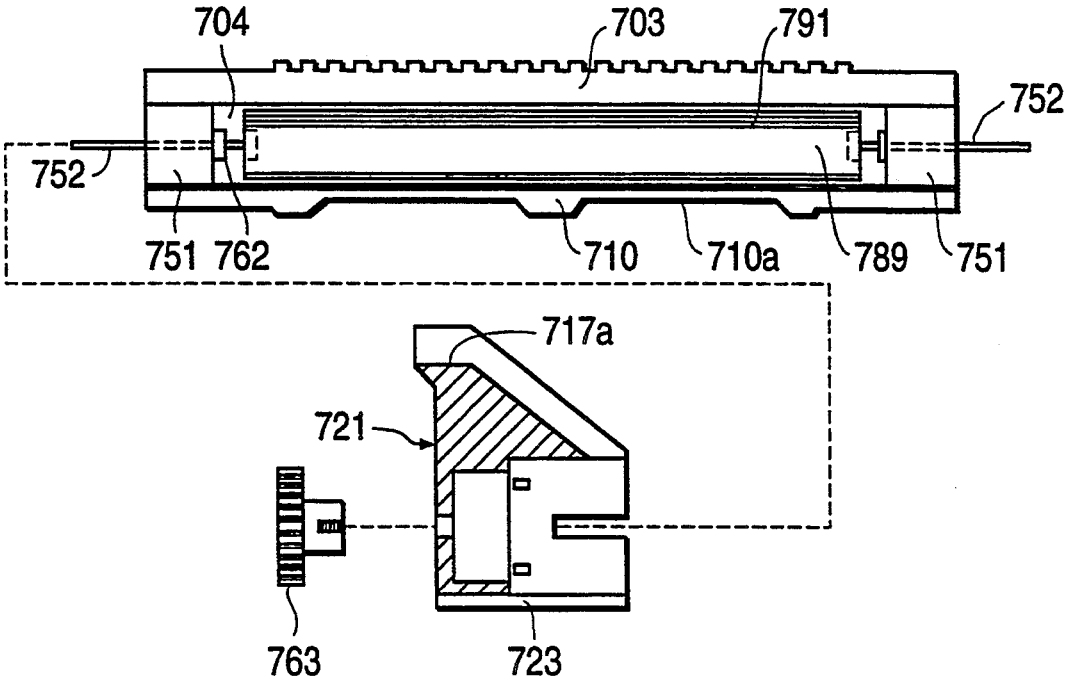
Figure 28C:
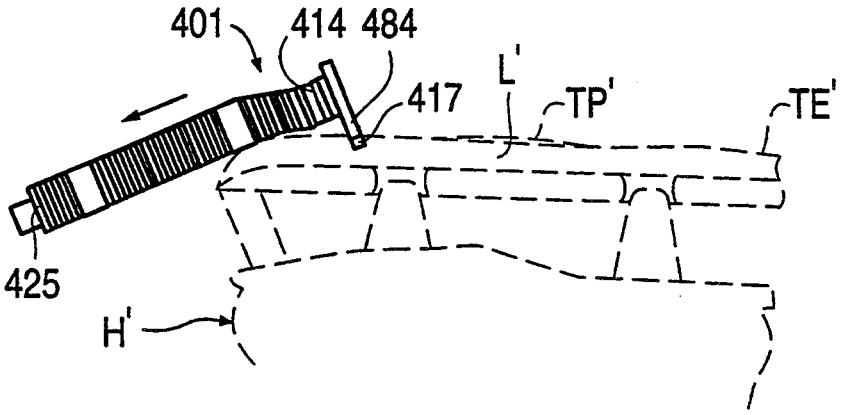
Figure 29C:
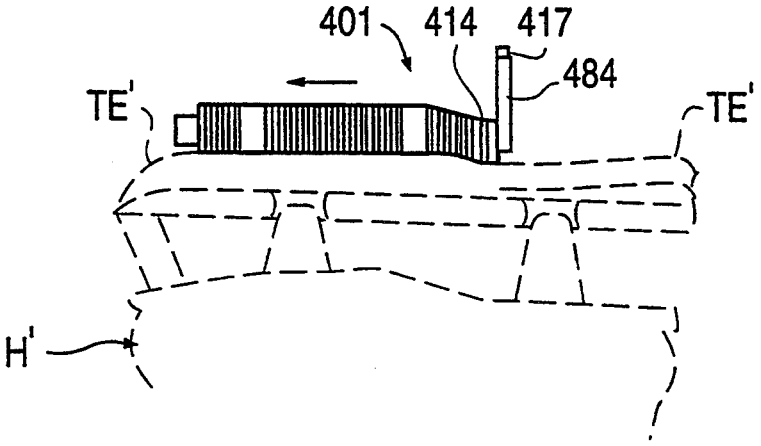
Figure 30C:
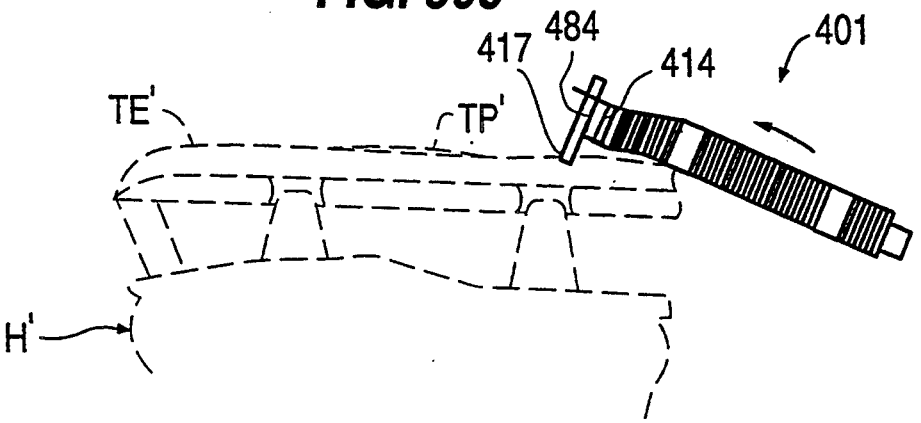
Figure 28D:
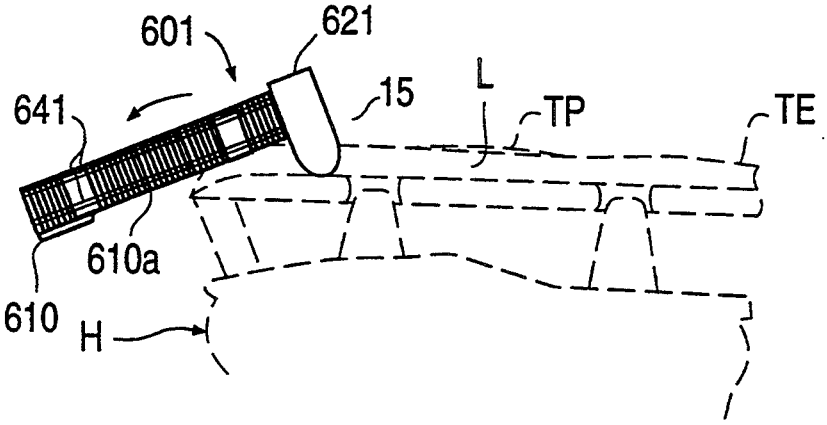
Figure 29D:
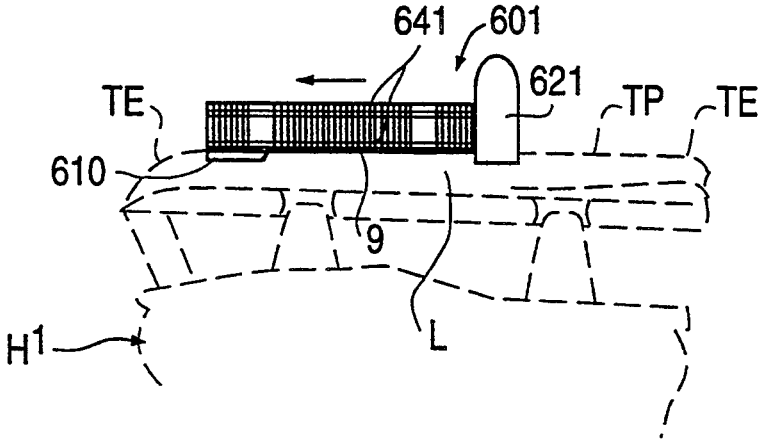
Figure 30D:
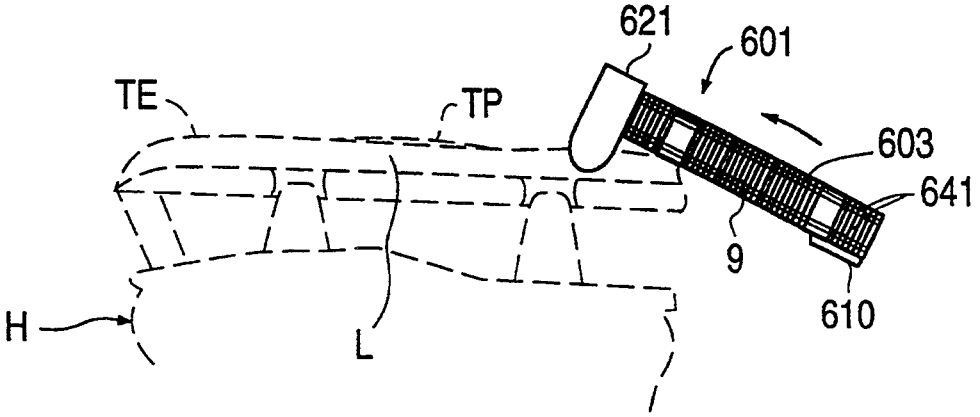
Figure 28A:
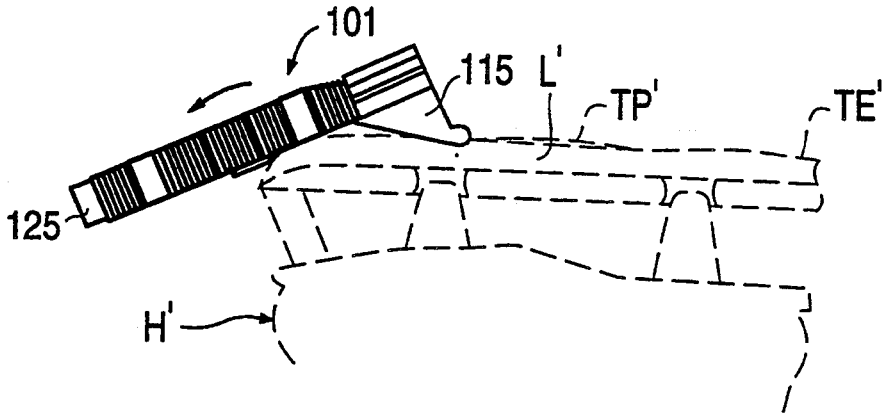
Figure 29A:
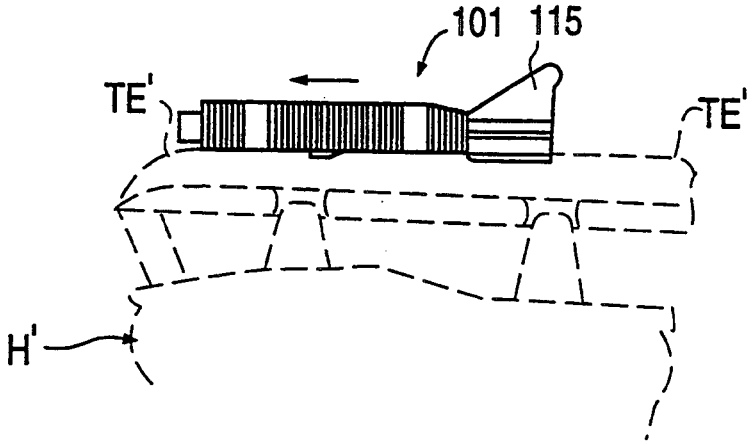
Figure 30A:
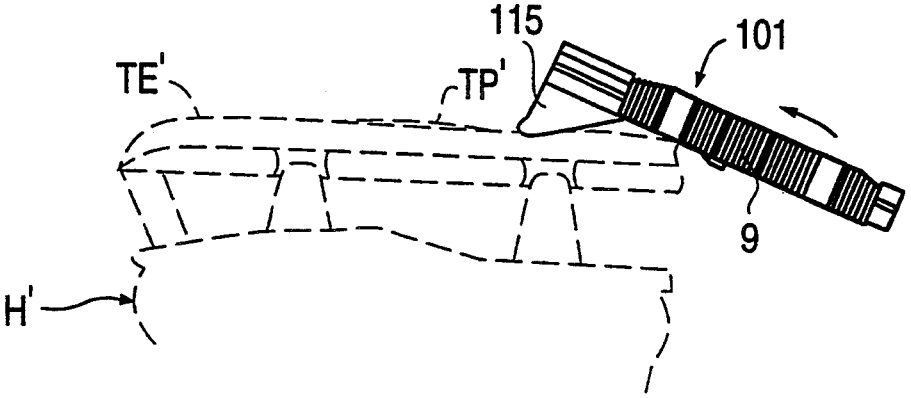
Figure 28B:
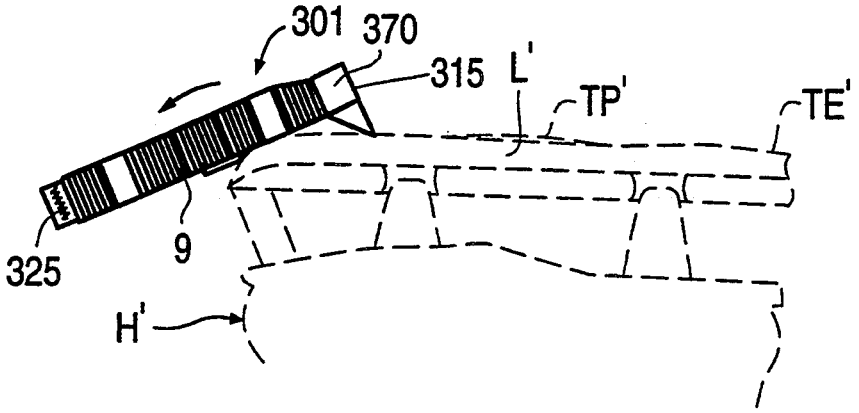
Figure 29B:
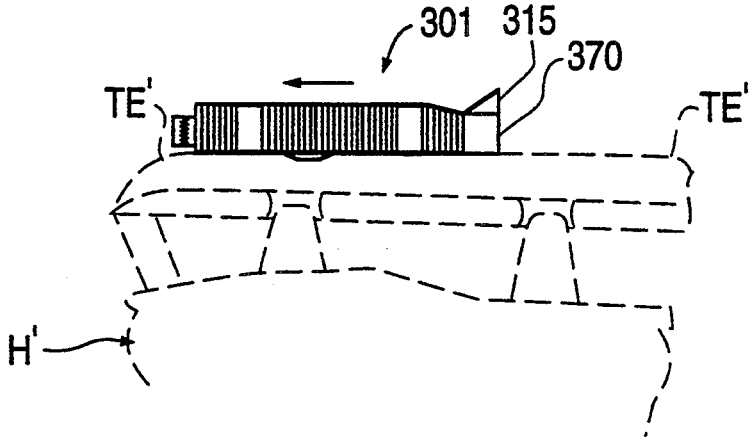
Figure 30B:
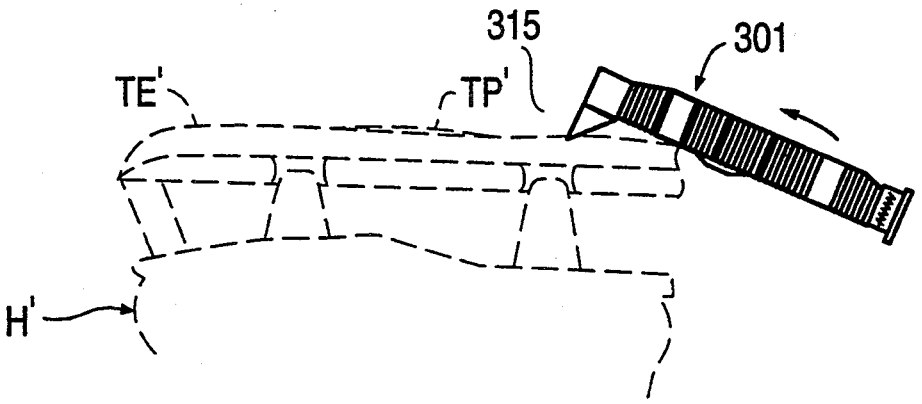
Figure 31:
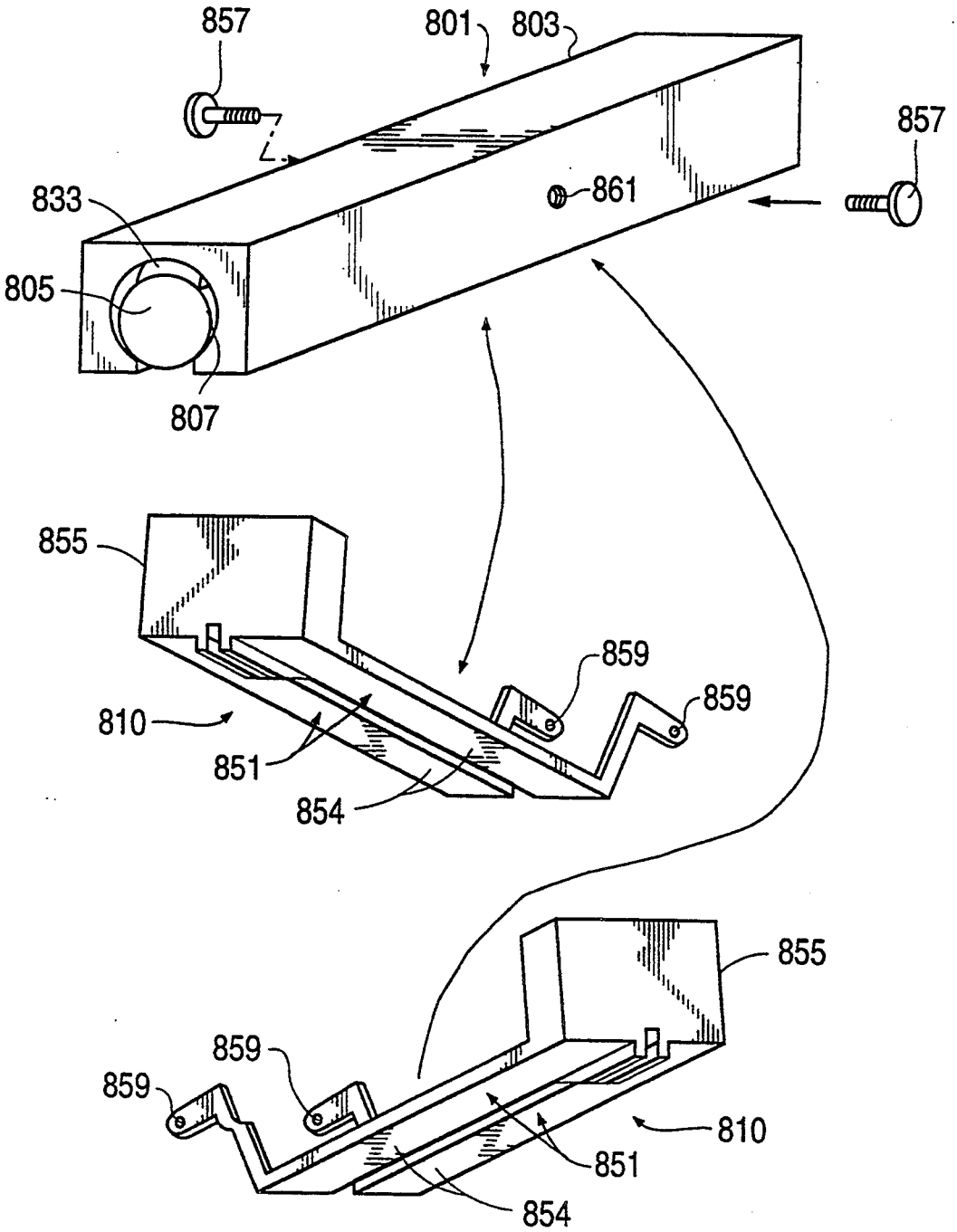
FIG. 31 represents a perspective exploded view of another aspect of the sharpener making the object of the invention.
Figure 32:
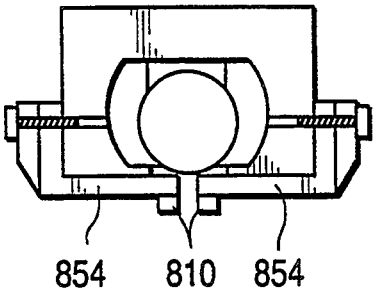
FIG. 32 represents a cross-sectional view of the sharpener of FIG. 31.
Figure 33:
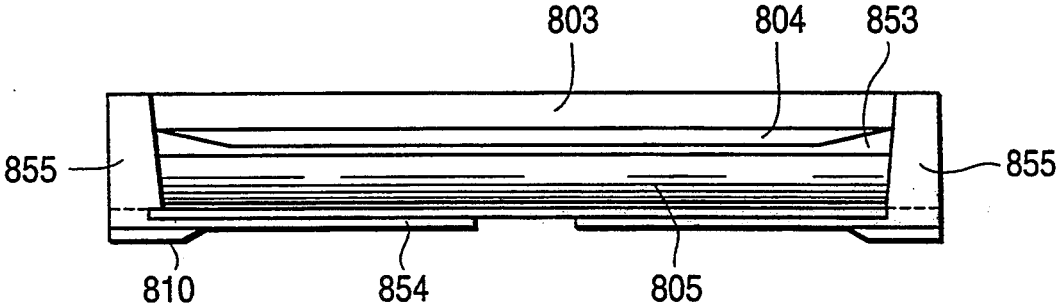
FIG. 33 represents a longitudinal cross-sectional view of the sharpener of FIG. 31.
Figure 34:
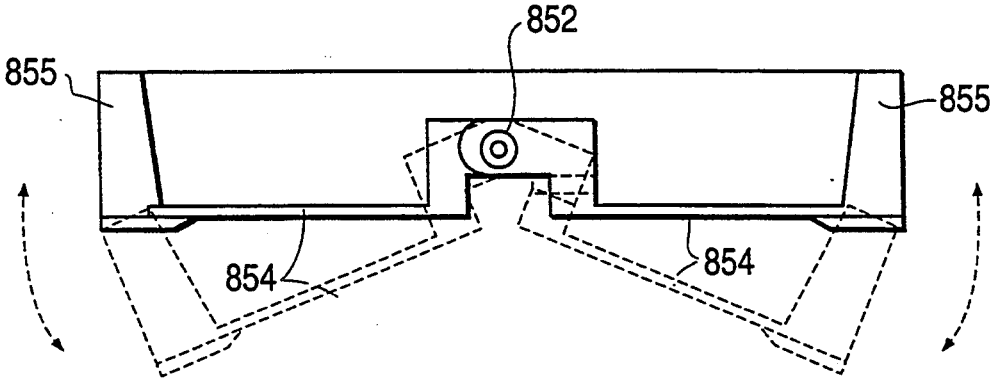
FIG. 34 represents a side elevational view of the sharpener of FIG. 31 where it is illustrated how guiding means may be moved.

According to an optional aspect of the invention, with reference to FIGS. 26 and 27, the file may be mounted inside a housing 704 of body 703 by fastening means that may consist for example of two supports 751 which the shape matches with the periphery of the housing 704 where is housed the file 705, each support 751 being provided with a central opening 755 in which is positioned a shaft 757 having opposite ends, one of the ends being provided with a member 750 comprising at least one edge and its opposite end and being provided with means allowing to fasten it to a lever (for example a button) 763, the shaft being further provided between the member provided with a edge where is positioned the shaft in the corresponding support, a stopper member 767 for thus allowing to mount the file 705 in a pivoting way in the housing.

In a particularly preferred way, means may be provided between the stopping member and one corresponding radial face of a corresponding support 751 for removably locking the file 705 with respect to the support.

In a particularly advantageous way, the file may consist of an elongated support 789 that is fitted out with at least one member 791, preferably several members for example three provided with an abrasive surface of distinct shape. The support may be made of any appropriate material, in particular of plastic material.

According to another aspect of the invention making the object of the present patent application, the invention relates to a portable sharpener 801 intended to be used for sharpening blades of the type comprising a main portion provided with one or several cutting edges and one or two end portions each provided with one or several cutting edges, said main portion having parallel lateral faces and one or several cutting edges substantially curved when more than one cutting edge is provided, said cutting edges being substantially parallel between them, each of said end portions extending one corresponding end of the main portion and each having lateral faces parallel and coplanar with those of the main portion and having one or several cutting edges substantially curved. This sharpener 801 comprising a body 803 having a main longitudinal axis, a housing 804 and including:

- a file 805 having a longitudinal axis and at least one abrasive surface 807 parallel to said longitudinal axis and the longitudinal axis of the body 803;
- means for fastening the file 805 inside the housing 804;
- guiding means 810 for allowing to a portion of the cutting edges to be moved against the abrasive surface 807 of the file 805 along the longitudinal axis of this one;
- means for recovering the filings obtained during the sharpening of the blade, said means being located between said first guiding means 801 and the abrasive surface of the file 805; and
- means for moving the guiding means 807 parallel to lateral faces of the blade and position these latter between said guiding means 810.

In a particularly advantageous way, the portable sharpener 801 is characterized in that the guiding means 801 consist of two members 851 mounted in pivoting way to an intermediary portion of the body 803 where each member 851 comprising two rails 854 parallel between them having opposite ends, one of the ends of each rail 854 being mounted in a pivoting way in an intermediary point of the length of the body 803 while the opposite end is solidly fastened with a transversal member 855 insuring the maintaining of the space between the rails 854, said rails 854 may be set around the pivot points 857 between a first position where the rail 854 are against the body 803 and a second position where the rails 854 are at angle with respect to the longitudinal axis of the body 803.

Preferably, the sharpener 801 shows that for mounting in a pivoting way one or several ends of rails 854 to the body 803, each rail is provided with an opening 859 at one of its ends, each opening 859 being aligned with one corresponding opening 861 provided in the body 803, then a pivot 863 is engaged through said openings 859 and 861 to join them together in a pivoting way.

More particularly, it is preferred to join two openings 859 and one opening 861 by means of a same pivot 863. To do so, it may be advantageous to provide a deformation of a band in the neighbourhood of the pivot, in the rails 854.

The file 805 may be mounted inside the body 803 by appropriate fastening means, in particular those described previously. Furthermore the file may show the characteristics of those previously defined.

Figure 35:
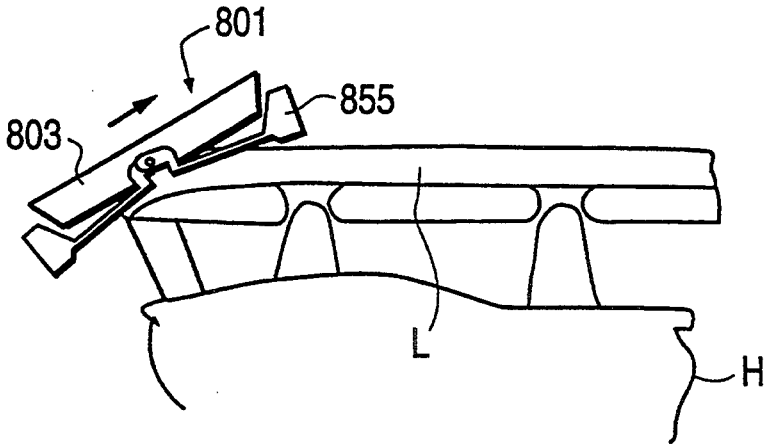
FIGS. 35 to 37 represents how we can use the sharpener of FIGS. 31 to 34.
Figure 36:
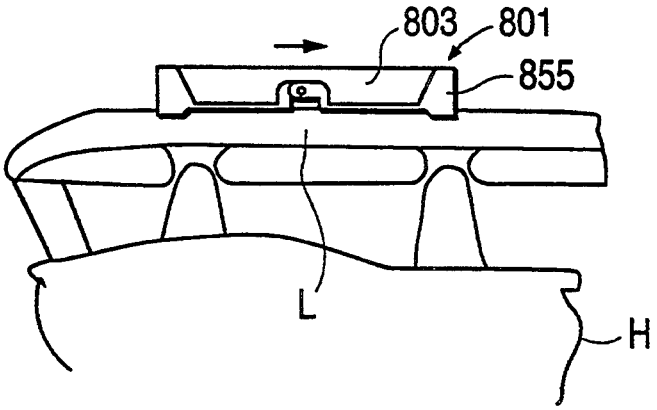
Figure 37:
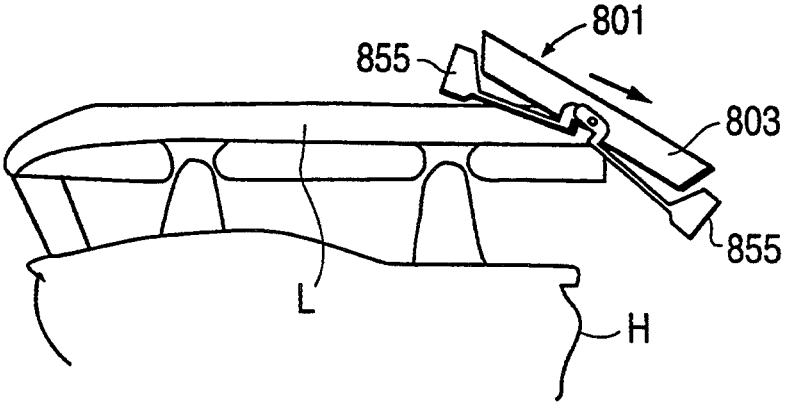

Referring to FIGS. 35 to 37, it is represented how we can use the sharpener represented in FIGS. 31 to 34. Thus, all what the user has to do is to move the members 851 around the pivot 863 in such a way that the rails 851 be facing the lateral face of the blade to be sharpened. The user only has to start to apply pressure by means of the file against the cutting edges of the blade from end of the blade and to continue this pressure always in the same direction while taking care to adjust if necessary the position of the rails 851 so that these ones remain facing the lateral faces of the blade to sharpen.

The present invention also covers all possible variations that could appear obvious for man skilled in the art. Furthermore, all the parts of the sharpener defined previously may be made of any known and appropriate materials, in particular of plastic materials (except for the file or file inserts defining abrasive surfaces).

The embodiment of the invention, in which an exclusive right of property or privilege is claimed, are defined are follows:

1. A portable sharpener for a blade of the type comprising a main portion provided with at least one cutting edge and one end portion provided with at least one cutting edge, the main portion having parallel lateral faces and at least one cutting edge substantially straight or slightly curved and when more than one cutting edge is provided, the cutting edges being substantially parallel, the end portion extending one corresponding end of the main portion and having lateral faces parallel and coplanar with those of the main portion and having at least one cutting edge substantially curved, the sharpener comprising a body having a main longitudinal axis, a housing and including:

- a file having a longitudinal axis and at least one abrasive surface parallel to the longitudinal axis and to the main longitudinal axis of the body;
- means for fastening the file in the housing;
- first guiding means for a portion of the cutting edges of the blade to be moved against the abrasive surface of the file along the longitudinal axis of the file;
- means for recovering the filings obtained during the sharpening of the blade, said means being located between the first guiding means and the abrasive surface of the file; and
- means for the selective positioning of the abrasive surface with respect to the at least one cutting edge of the main portion of the blade, between at least two distinct positions, a first of the distinct positions being defined when the cutting edge of the main portion of the blade may be substantially parallel or tangent with the abrasive surface, another of the distinct positions being defined when the cutting edge of the main portion of the blade may form an angle with respect to the abrasive surface and the cutting edge of the end portion may be substantially tangent with at least one portion of the abrasive surface, said means comprising:
  - a removable crutch mounted on the body and provided with second guiding means intended to contact a portion of the cutting edge, the crutch being mounted in a removable way on the body between two distinct positions, that is at least one distinct position where the second guiding means are not intended to be in contact with the cutting edge to allow the abrasive surface to be contacted by the cutting edge in a way substantially parallel or tangent, and at least one other distinct position where the second guiding means are intended to be in contact with the cutting edge while being positioned between the file and the cutting edge of the main portion of the blade to thus allow lifting of one end of the file with respect to the cutting edge of the main portion of the blade and thus form an angle, between them;

means for moving the crutch between one distinct position toward one another distinct position;

wherein when the crutch is positioned in such a way as to have its second guiding means between the file and the cutting edge of the main portion of the blade, the second guiding means cooperate with the first guiding means to guide at least a portion of the cutting edge of a corresponding end portion of the blade along the abrasive surface of the file and thus allow sharpening of the cutting edge.

2. A portable sharpener according to claim 1, for sharpening a blade of the type comprising a main portion provided with two parallel cutting edges and end portion provided with two parallel cutting edges, the main portion of the blade having cutting edges that are slightly curved, wherein the body is provided with a housing in which is housed the file and a slot parallel to the longitudinal axis giving access to the file, the crutch being mounted in a removable way on the body at either end for allowing the file to sharpen the cutting edges of the blade in a same direction.

3. A portable sharpener according to claim 2, wherein the crutch comprises a sleeve removable and mounted in a pivoting way on the body, the sleeve being provided with a longitudinal slot wherein the means for moving the crutch from one distinct position to another comprises:

a shoulder provided at each end of the body and having a substantially cylindrical outer surface, and a longitudinal slot extending from the slot of the body, the outer surface having a longitudinal axis substantially co-axial with the main longitudinal axis of the body; and an inner cylindrical surface for the sleeve; wherein the inner surface of the sleeve is intended to be mounted in a pivoting way on the outer surface of either of the shoulders between at least two distinct positions, that is at least one distinct position where the second guiding means are not intended to be positioned between the file and the cutting edges of the main portion of the blade and where the slot of the sleeve is aligned with the slot of the body, in order to allow the cutting edges of the main portion of the blade to contact the abrasive surface of the file, and another distinct position where the second guiding means are intended to be positioned between the abrasive surface of the file and the cutting edges of the main portion of the blade to thus allow positioning of one end of the file at a given distance from the cutting edges in order to create an angle between them.

4. A portable sharpener according to claim 3, wherein the outer surface of the sleeve is provided with three protuberances each defining a crutch of a different height, each protuberance being provided with second guiding means.

5. A portable sharpener according to claim 2, wherein the crutch comprises a wedge shaped portion provided with a slot defining the second guiding means and a "U" shaped portion provided with small protuberances at the inside of each branch of said "U", the small protuberances being intended to engage corresponding small cavities provided inside corresponding notches located at each end of the body, the second guiding means being intended to be positioned between the file and the cutting edges of the main portion of the blade when the wedge shaped portion is positioned above the longitudinal slot of the body, the second guiding means being not in contact with the cutting edges when the opening of the "U" shaped portion is on the side of the longitudinal slot in the body.

6. A portable sharpener according to claim 2, wherein the crutch comprises a removable button mounted on the body and provided with a member having opposite ends and showing at one of its ends the second guiding means, the member being fastened in a removable way to the button by a tongue and groove assembly, the second guiding means being positioned between the longitudinal axis of the file and the cutting edges of the main portion of the blade when the button is mounted at either end of the body, the second guiding means being not in contact with the body when the button is removed from the body.

7. A portable sharpener according to claim 2, wherein the longitudinal slot is sided by the first guiding means and the means for recovering the filings comprise another housing located on each side of the longitudinal slot between the first guiding means and the abrasive surface of the housing.

8. A portable sharpener according to claim 2, wherein the crutch comprises a sleeve removable and mounted in a pivoting way on the body, the sleeve being provided with a longitudinal slot and the means for moving the crutch from one distinct position to another comprises:

an outer cylindrical surface for the body;

an inner cylindrical surface for the sleeve; wherein the inner surface is intended to be mounted in a pivoting way on the outer surface of the body between at least two distinct positions, that is at least one distinct position where the second guiding means are not intended to be positioned between the file and the cutting edges of the main portion of the blade and the slot of the sleeve is aligned with the slot of the body, for allowing the cutting edges of the main portion of the blade to contact the abrasive surface of the file, and another distinct position where the second guiding means are positioned between the abrasive surface of the file and the cutting edges of the main portion of the blade to thus allow positioning of one end of the file at a distance from the cutting edges in order to create an angle between them; and wherein the sleeve may slide along the body from one end to the other to thus allow modification of the value of the angle that the file may make with respect to the main portion of the blade.

9. A portable sharpener according to claim 8, wherein the outer surface of the body is provided with at least one guiding notch and the inner surface of the sleeve is provided with a small protuberance intended to engage a corresponding guiding notch.

10. A portable sharpener according to claim 9, wherein several guiding notches are provided and each of the guiding notches is provided with means adapted to cooperate with the corresponding protuberance for removably locking the sleeve at a given position along the body.

11. A portable sharpener according to claim 8, wherein the first guiding means are provided on each bank of the longitudinal slot.

12. A portable sharpener according to claim 11, wherein the first guiding means consist of two identical rails having a given height, the rails being parallel and at a given distance from each other and each of the rails making an integral part of the bank of the longitudinal slot of the body.

13. A portable sharpener according to claim 12, wherein each of the rails has at least one intermediary portion of reduced height.

14. A portable sharpener according to claim 13, wherein each the rails has at least two intermediary portions of reduced height.

15. A portable sharpener according to claim 2, wherein the file is mounted inside the housing of the body by appropriate fastening means.

16. A portable sharpener according to claim 15, wherein the fastening means comprise at least one threaded rod engaging a threaded hole provided in the body and communicating with the housing, the rod engaging the file when screwed toward the inside of the housing for pressing the file against a wall of the housing provided with the longitudinal slot of the body.

17. A portable sharpener according to claim 15, wherein the fastening means comprise a tongue of elastic material provided with protuberances at each end, the protuberances being of a height slightly superior to the distance separating the file from a ceiling of the housing for thus pressing the file against a floor of the housing and against the longitudinal slot.

18. A portable sharpener according to claim 15, wherein the fastening means comprise a tongue provided with lateral edges intended to engage corresponding grooves provided in lateral walls of the housing for thus pressing the file against the floor of the housing where the longitudinal slot is located.

19. A portable sharpener according to claim 15, wherein each end of the file is provided with a cavity having at least one edge, and the fastening means comprise two supports of a shape matching with the periphery of the housing, each support being provided with a central opening in which is positioned a shaft having opposite ends, one of the ends being provided with a member comprising at least one edge and intended to engage a corresponding cavity at one end of the file, and the opposite end of each shaft being provided with means for allowing connection to a lever means, the shaft being further provided, between the member provided with at least one edge and a location where the shaft enters in the corresponding support, of a stopper member, for thus allowing mounting of the file in a pivoting way in the housing.

20. A portable sharpener according to claim 19, wherein means are provided between the stopper member and the corresponding radial face of a corresponding support for locking in a removable way the file with respect to the support.

21. A portable sharpener according to claim 20, wherein the file comprises an elongated support that is fitted with at least one member provided with an abrasive surface.

22. A portable sharpener according to claim 21, wherein the elongated support comprises three fittings, each of the fittings being provided with an abrasive surface of distinct shape.

* * * * *